US012678017B2

(12) United States Patent
Fawaz et al.

(10) Patent No.: US 12,678,017 B2
(45) Date of Patent: Jul. 14, 2026

(54) DISHWASHER WITH COLLET STRAW CARRIER

(71) Applicant: Midea Group Co., Ltd., Beijiao (CN)

(72) Inventors: Bassam Fawaz, Louisville, KY (US); Robert M. Digman, Goshen, KY (US)

(73) Assignee: MIDEA GROUP CO., LTD., Beijiao (CN)

( * ) Notice: Subject to any disclaimer, the term of this patent is extended or adjusted under 35 U.S.C. 154(b) by 35 days.

(21) Appl. No.: 18/756,451

(22) Filed: Jun. 27, 2024

(65) Prior Publication Data

US 2024/0349981 A1 Oct. 24, 2024

Related U.S. Application Data

(63) Continuation-in-part of application No. 18/192,373, filed on Mar. 29, 2023.

(51) Int. Cl.
*A47L 15/50* (2006.01)

(52) U.S. Cl.
CPC ..... *A47L 15/505* (2013.01); *A47L 15/508* (2013.01)

(58) Field of Classification Search
None
See application file for complete search history.

(56) References Cited

U.S. PATENT DOCUMENTS

| | | | |
|---|---|---|---|
| 5,749,385 | A | 5/1998 | Rochette |
| 7,846,269 | B2 | 12/2010 | Dunn |
| 9,848,753 | B2 | 12/2017 | Chan et al. |
| 10,694,922 | B1 | 6/2020 | Audibert et al. |
| 10,814,363 | B2 | 10/2020 | Bowman |
| 10,932,647 | B1 | 3/2021 | Audibert |
| 2006/0065666 | A1 | 3/2006 | Dunn et al. |
| 2010/0226828 | A1 | 9/2010 | Itoh |
| 2018/0168430 | A1 | 6/2018 | Wilson |
| 2020/0237181 | A1 | 7/2020 | Campbell |

(Continued)

FOREIGN PATENT DOCUMENTS

| | | | |
|---|---|---|---|
| AU | 2020204169 | A1 | 1/2021 |
| CN | 208824553 | U | 5/2019 |

(Continued)

OTHER PUBLICATIONS

4RTIDES-Retail; Dishwasher Safe Straw Caddy, Retrieved from: https://4rtides.com/products/copy-of-dishwasher-safe-straw-caddy; Retrieved on: Feb. 9, 2024.

(Continued)

*Primary Examiner* — Levon J Shahinian
(74) *Attorney, Agent, or Firm* — Gray Ice Higdon

(57) ABSTRACT

A carrier for one or more straws of an appliance such as a dish washing appliance. The carrier and/or rack may be in fluid communication with one or more spray elements when in a stowed position within a dishwasher tub. The one or more carriers may route fluid from the one or more spray elements to wash an interior and/or an exterior of at least one straw. The carrier may include one or more bridges projecting inwardly towards the one or more straws defining one or more pathways for received fluid. The body of the carrier may include one or more adjustable portions. The carrier may be adjustable to engage one or more straws of varying lengths/diameters. The carrier may include one or more fixed portions. The carrier may include one or more biasing mechanisms.

24 Claims, 13 Drawing Sheets

(56) References Cited

U.S. PATENT DOCUMENTS

| | | | |
|---|---|---|---|
| 2021/0001385 | A1 | 1/2021 | Bowman |
| 2021/0045614 | A1 | 2/2021 | Ford |
| 2021/0274994 | A1 | 9/2021 | Garcia |
| 2022/0388040 | A1 | 12/2022 | Dunford |
| 2023/0284866 | A1 | 9/2023 | Fawaz |
| 2023/0284867 | A1 | 9/2023 | Fawaz et al. |
| 2024/0324846 | A1 | 10/2024 | Fawaz |

FOREIGN PATENT DOCUMENTS

| | | | |
|---|---|---|---|
| DE | 2019104788 | U1 | 9/2019 |
| DE | 2019104789 | U1 | 9/2019 |
| DE | 2020000021 | U1 | 6/2020 |
| DE | 2020100262 | U1 | 4/2021 |
| EP | 4108153 | A1 | 12/2022 |
| EP | 4108154 | A1 | 12/2022 |
| GB | 2576931 | A | 3/2020 |
| WO | 2024198685 | A1 | 10/2024 |

OTHER PUBLICATIONS

Shahinian, Levon J., United States Patent and Trademark Office, Non-Final Office Action issued in U.S. Appl. No. 17/693,962, 21 pages, dated Nov. 9, 2023.

Related Applications Transmittal dated Jun. 27, 2024.

Shahinian, Levon J., United States Patent and Trademark Office, Non-Final Office Action issued in U.S. Appl. No. 17/824,599, 27 pages, dated Jan. 19, 2024.

Shahinian, Levon J., United States Patent and Trademark Office, Notice of Allowance issued in U.S. Appl. No. 17/693,962, 26 pages, dated Feb. 28, 2024.

Shahinian, Levon J., United States Patent and Trademark Office, Notice of Allowance issued in U.S. Appl. No. 17/824,599, 20 pages, dated May 10, 2024.

International Searching Authority, International Search Report and Written Opinion issued in Application No. PCT/CN2024/074067, 9 pages, dated May 5, 2024.

DISHWASHER WITH COLLET STRAW CARRIER

BACKGROUND

The present embodiments relate to a carrier for one or more straws of a variety of diameters/lengths, with particular embodiments shown for a dishwasher rack of a dish washing appliance.

Typical straws are placed in a vertical position within a silverware basket and/or a dishwasher rack. However, this practice often is inconsistent in cleaning the inside and/or outside of the one or more straws with fluid randomly being used during the wash cycle. Thus, there is a need to improve washing of one or more straws of a variety of lengths/diameters in a dish washing appliance.

SUMMARY

In some embodiments of the invention, for example, a collet straw carrier for a dish washing appliance may include a fixed portion and/or an adjustable portion defining a receptacle configured to receive an end of a straw. In various embodiments, the carrier may include one or more biasing mechanisms. In some embodiments, the one or more biasing mechanisms urges the adjustable portion relative to the fixed portion to releasably engage an end of a straw within the receptacle.

In various embodiments, the one or more biasing mechanisms urges the adjustable portion radially inward relative to the fixed portion towards an end of a straw in the receptacle. In some embodiments, the carrier may include an axial stop within the receptacle. In various embodiments, the adjustable portion may be configurable between a first position at a first radius and a second position at a second radius larger than the first radius. In some embodiments, the one or more biasing mechanisms may have a larger spring force when the adjustable portion is in the second position than the first position. In various embodiments, the carrier may include a first end and an opposing second end, and the adjustable portion may be on the second end and the fixed portion may be on the first end. In some embodiments, the adjustable portion may be hingedly connected to the fixed portion. In various embodiments, the adjustable portion may include two or more pivoting members hingedly connected to the fixed portion. In some embodiments, the adjustable portion may include a circumferential groove receiving the one or more biasing mechanisms. In various embodiments, the adjustable portion may be slidably connected to the fixed portion. In some embodiments, the fixed portion may include one or more slots slidably receiving one or more sliding members of the adjustable portion. In various embodiments, the one or more sliding members may slide perpendicular to an axis of the receptacle. In some embodiments, the one or more sliding members and/or one or more slots may be elongated and extend for a length along an axis of the receptacle. In various embodiments, the one or more bias mechanisms may extend circumferentially about an axis of the receptacle. In some embodiments, the carrier may include a funnel defining an inlet of the receptacle.

In some embodiments, a dish washing appliance may include a dishwasher tub. In various embodiments, the appliance may include one or more spray elements disposed in the dishwasher tub. In some embodiments, the one or more spray elements may include one or more apertures. In various embodiments, the one or more spray elements may be in fluid communication with a fluid supply to direct fluid from the fluid supply into the dishwasher tub. In some embodiments, the appliance may include one or more collet straw carriers positioned downstream of the one or more spray elements and/or apertures. In various embodiments, the carrier may include a fixed portion, an adjustable portion, and/or one or more biasing mechanisms. In some embodiments, the fixed portion and/or the adjustable portion may define a receptacle configured to receive an end of a straw. In various embodiments, the one or more biasing mechanisms may urge the adjustable portion relative to the fixed portion to releasably engage an end of a straw within the receptacle.

In various embodiments, the adjustable portion may be slidably connected to or hingedly connected to the fixed portion. In some embodiments, the adjustable portion may be slidably connected to the fixed portion. In various embodiments, the adjustable portion may be hingedly connected to the fixed portion. In some embodiments, the bias mechanism may extend circumferentially about an axis of the receptacle. In various embodiments, the appliance may include a funnel defining an inlet of the receptacle. In some embodiments, the one or more biasing mechanisms may urge the adjustable portion radially inward relative to the fixed portion towards an end of a straw in the receptacle. In various embodiments, the appliance may include an axial stop within the receptacle. In some embodiments, the adjustable portion may be configurable between a first position at a first radius and a second position at a second radius larger than the first radius. In various embodiments, the one or more biasing mechanisms may have a larger spring force when the adjustable portion is in the second position than the first position.

In some embodiments of the invention, for example, a method of releasably engaging one or more straws with a collet straw carrier within a dish washing appliance may include providing at least one collet straw carrier within a dishwasher tub. In various embodiments, the carrier may include one or more fixed portions and one or more adjustable portions, and wherein the one or more adjustable portions may move relative to the one or more fixed portions. In some embodiments, the method may include varying a radial position of the one or more adjustable portions relative to the one or more fixed portions. In various embodiments, the method may include releasably engaging an end of a straw.

In various embodiments, the method may include pivoting the one or more adjustable portions relative to the one or more fixed portions. In some embodiments, the method may include sliding the one or more adjustable portions relative to the one or more fixed portions. In various embodiments, the method may include biasing the one or more adjustable portions relative to the one or more fixed portions.

In some embodiments, a dishwasher rack for a dish washing appliance may include one or more collet straw carriers having one or more fixed portions and one or more adjustable portions defining one or more receptacles configured to each receive an end of a straw. In some embodiments, an axis of the one or more receptacles may be substantially perpendicular to a direction of travel of the dishwasher rack. In some embodiments, the dishwasher rack may include one or more biasing mechanisms. In various embodiments, the one or more biasing mechanisms may urge the one or more adjustable portions relative to the one or more fixed portions to releasably engage an end of a straw within the one or more receptacles.

In addition, in some embodiments, one or more biasing mechanisms may urge the one or more adjustable portions radially inward relative to the fixed portion towards an end of a straw in the one or more receptacles and/or vertical axis. In various embodiments, the dishwasher rack may include a front side, and wherein the one or more collet straw carriers may be positioned adjacent the front side. In some embodiments, the one or more adjustable portions may be configurable between a first position at a first radius and a second position at a second radius larger than the first radius. In various embodiments, the one or more collet straw carriers may include an upper end and an opposing lower end, and the one or more adjustable portions may be on the upper end and the one or more fixed portions may be on the lower end. In various embodiments, the one or more adjustable portions may include two of more pivoting members hingedly connected to the one or more fixed portions. In some embodiments, the one or more adjustable portions slide perpendicular to the axis of the one or more receptacles. In various embodiments, the one or more bias mechanisms may extend circumferentially about the axis of the receptacle. In some embodiments, the dishwasher rack may include a bottom side, and wherein the fixed portion may include a manifold adjacent the bottom side. In various embodiments, the manifold may include one or more drains.

In some embodiments, a dish washing appliance may include a dishwasher rack. In various embodiments, the appliance may include one or more spray elements disposed with the dishwasher rack, wherein the one or more spray elements may be in fluid communication with a fluid supply to direct fluid from the fluid supply into the dishwasher rack. In some embodiments, the appliance may include one or more collet straw carriers positioned within the dishwasher rack and downstream of the one or more spray elements. In various embodiments, the carrier may include a fixed portion, an adjustable portion, and/or one or more biasing mechanisms. In some embodiments, the fixed portion and/or the adjustable portion may define a receptacle configured to receive an end of a straw. In various embodiments, the one or more biasing mechanisms may urge the adjustable portion relative to the fixed portion to releasably engage an end of a straw within the receptacle.

In addition, in some embodiments, an axis of the receptacle may be substantially perpendicular to a direction of travel of the dishwasher rack. In various embodiments, the adjustable portion may be slidably connected to the fixed portion and slides in a perpendicular direction to the axis of the receptacle. In some embodiments, the adjustable portion may be hingedly connected to the fixed portion and pivots one end of the adjustable portion away from the axis of the receptacle. In various embodiments, the one or more bias mechanisms may extend circumferentially about the axis of the receptacle. In some embodiments, the one or more biasing mechanisms may urge the adjustable portion radially inward relative to the fixed portion towards an end of a straw in the receptacle. In various embodiments, the dish washing appliance may include a plurality of elongated protrusions projecting inwardly along the axis of the receptacle and tapering towards an inlet of the receptacle. In some embodiments, the adjustable portion may include a plurality of members. In some embodiments, the plurality of members may define an outlet of the receptacle configured to receive one end of a straw. In various embodiments, the outlet may include a diameter, and wherein the plurality of members are positionable between a first position and a second position, wherein the diameter of the outlet may be larger in the second position than in first second position. In some embodiments, the bias mechanism may include a larger spring force when the plurality of members are in the second position than in the first position. In various embodiments, the dishwasher rack maybe a bottom rack.

In some embodiments, a method of releasably engaging one or more straws with a collet straw carrier within a dish washing appliance may include providing at least one collet straw carrier within a dishwasher rack, wherein at least one straw carrier may include one or more fixed portions and one or more adjustable portions, and wherein the one or more adjustable portions may move relative to the one or more fixed portions. In various embodiments, the method may include varying a radial position of the one or more adjustable portions relative to the one or more fixed portions. In some embodiments, the method may include releasably engaging one end of a straw.

In addition, in some embodiments, the step of varying the radial position may include vertically inserting one end of a straw into one or more receptacles defined by the one or more adjustable portions. In various embodiments, the method may include pivoting the one or more adjustable portions relative to the one or more fixed portions. In some embodiments, the method may include sliding the one or more adjustable portions relative to the one or more fixed portions. In various embodiments, the method may include biasing the one or more adjustable portions relative to the one or more fixed portions. In some embodiments, the one or more fixed portions may include a manifold, and further includes the step of draining the manifold.

In some embodiments, a dishwasher rack for a dish washing appliance may include one or more collet straw carriers having one or more fixed portions and one or more adjustable portions defining one or more receptacles configured to each receive an end of a straw. In various embodiments, an axis of the one or more receptacles are perpendicular to a direction of travel of the dishwasher rack. In some embodiments, the dishwasher rack may include one or more biasing mechanisms. In various embodiments, the one or more biasing mechanisms may urge the one or more adjustable portions relative to the one or more fixed portions to releasably engage an end of a straw within the one or more receptacles.

In addition, in some embodiments, the one or more biasing mechanisms may urge the one or more adjustable portions radially inward relative to the fixed portion towards an end of a straw in the one or more receptacles. In various embodiments, the dishwasher rack may include a front side, and wherein the one or more collet straw carriers may be positioned adjacent the front side. In some embodiments, the one or more adjustable portions may be configurable between a first position at a first radius and a second position at a second radius larger than the first radius. In various embodiments, the one or more collet straw carriers may include an upper end and an opposing lower end, and the one or more adjustable portions may be on the upper end and the one or more fixed portions may be on the lower end. In some embodiments, the one or more adjustable portions may include two of more pivoting members hingedly connected to the one or more fixed portions. In various embodiments, the one or more adjustable portions may slide perpendicular to the axis of the one or more receptacles. In some embodiments, the one or more bias mechanisms may extend circumferentially about the axis of the receptacle. In various embodiments, the dishwasher rack may include a bottom side, and wherein the fixed portion includes a manifold adjacent the bottom side, and wherein the manifold includes one or more drains.

In some embodiments, a dish washing appliance may include a dishwasher rack. In various embodiments, the appliance may include one or more spray elements disposed with the dishwasher rack. In some embodiments, the one or more spray elements may be in fluid communication with a fluid supply to direct fluid from the fluid supply into the dishwasher rack. In various embodiments, the one or more collet straw carriers may be positioned within the dishwasher rack and downstream of the one or more spray elements. In some embodiments, the carrier may include a fixed portion, an adjustable portion, and one or more biasing mechanisms. In various embodiments, the fixed portion and the adjustable portion may define a receptacle configured to receive an end of a straw. In some embodiments, the one or more biasing mechanisms may urge the adjustable portion relative to the fixed portion to releasably engage an end of a straw within the receptacle.

In addition, in some embodiments, an axis of the receptacle may be perpendicular to a direction of travel of the dishwasher rack. In various embodiments, the adjustable portion may be slidably connected to the fixed portion and may slide in a perpendicular direction to the axis of the receptacle. In some embodiments, the adjustable portion may be hingedly connected to the fixed portion and may pivot one end of the adjustable portion away from the axis of the receptacle. In various embodiments, the one or more bias mechanisms may extend circumferentially about the axis of the receptacle. In some embodiments, the one or more biasing mechanisms may urge the adjustable portion radially inward relative to the fixed portion towards an end of a straw in the receptacle. In various embodiments, the dish washing appliance may include a plurality of elongated protrusions projecting inwardly along the axis of the receptacle and tapering towards an inlet of the receptacle. In some embodiments, the adjustable portion may include a plurality of members, wherein the plurality of members define an outlet of the receptacle configured to receive one end of a straw. In various embodiments, the outlet may include a diameter. In some embodiments, the plurality of members may be positionable between a first position and a second position. In various embodiments, the diameter of the outlet may be larger in the second position than in first second position. In some embodiments, the bias mechanism may include a larger spring force when the plurality of members are in the second position than the first position. In various embodiments, the dishwasher rack may be a bottom rack.

In some embodiments, a method of releasably engaging one or more straws with a collet straw carrier within a dish washing appliance may include providing at least one collet straw carrier within a dishwasher rack, wherein at least one straw carrier includes one or more fixed portions and one or more adjustable portions, and/or wherein the one or more adjustable portions move relative to the one or more fixed portions. In various embodiments, the method may include varying a radial position of the one or more adjustable portions relative to the one or more fixed portions. In some embodiments, the method may include releasably engaging one end of a straw.

In addition, in some embodiments, varying the radial position may include vertically inserting one end of a straw into one or more receptacles defined by the one or more adjustable portions. In various embodiments, the method may include pivoting the one or more adjustable portions relative to the one or more fixed portions. In some embodiments, the method may include sliding the one or more adjustable portions relative to the one or more fixed portions. In various embodiments, the method may include biasing the one or more adjustable portions relative to the one or more fixed portions. In some embodiments, the one or more fixed portions may include a manifold. In various embodiments, the method may include draining the manifold.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
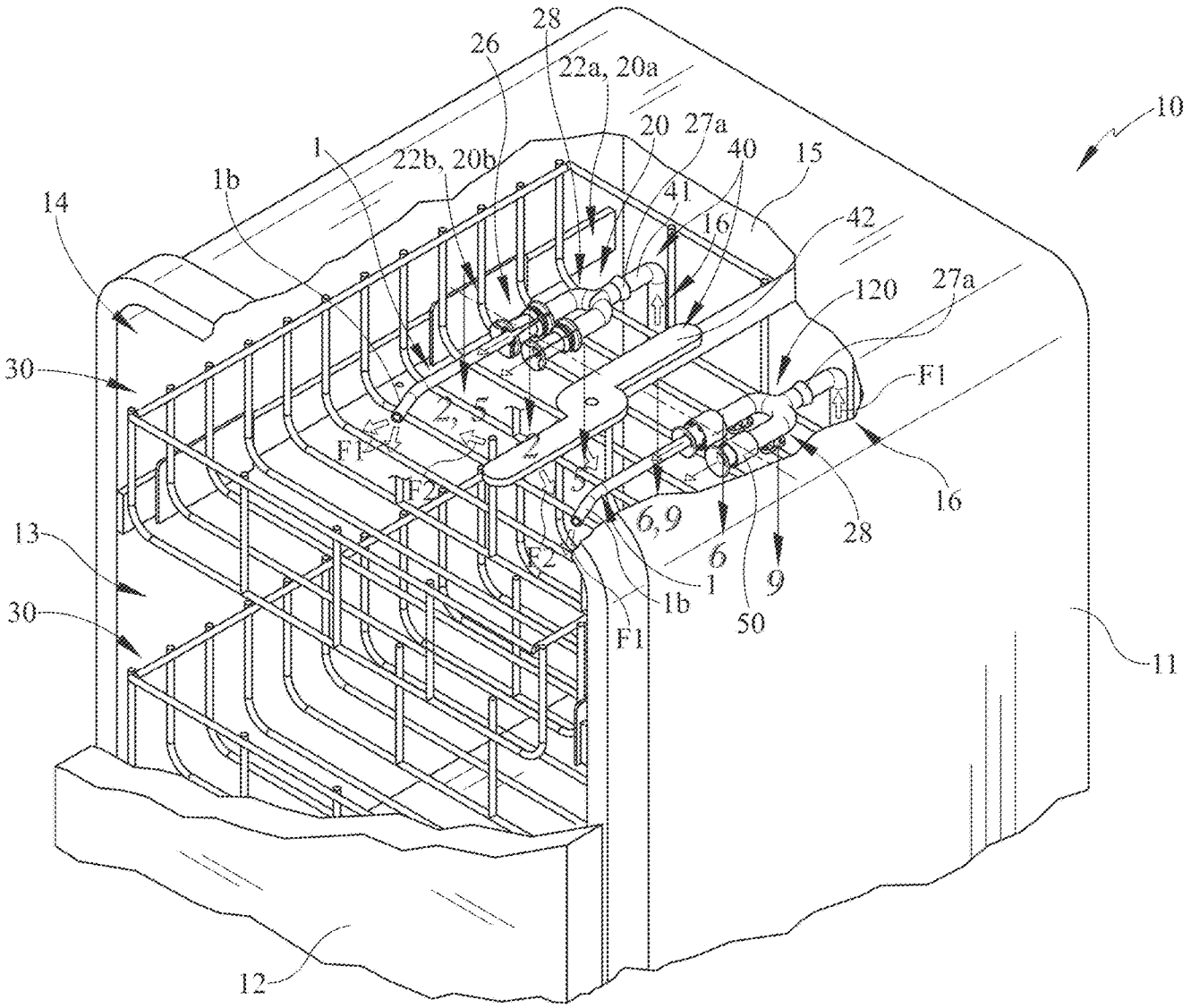
FIG. 1 is a perspective view of one embodiment of an upper/third dishwasher rack illustrating two embodiments of a carrier for at least one straw supported by the stowed rack and in fluid communication with one or more spray elements, with portions of the housing and dishwasher tub removed.
Figure 2:
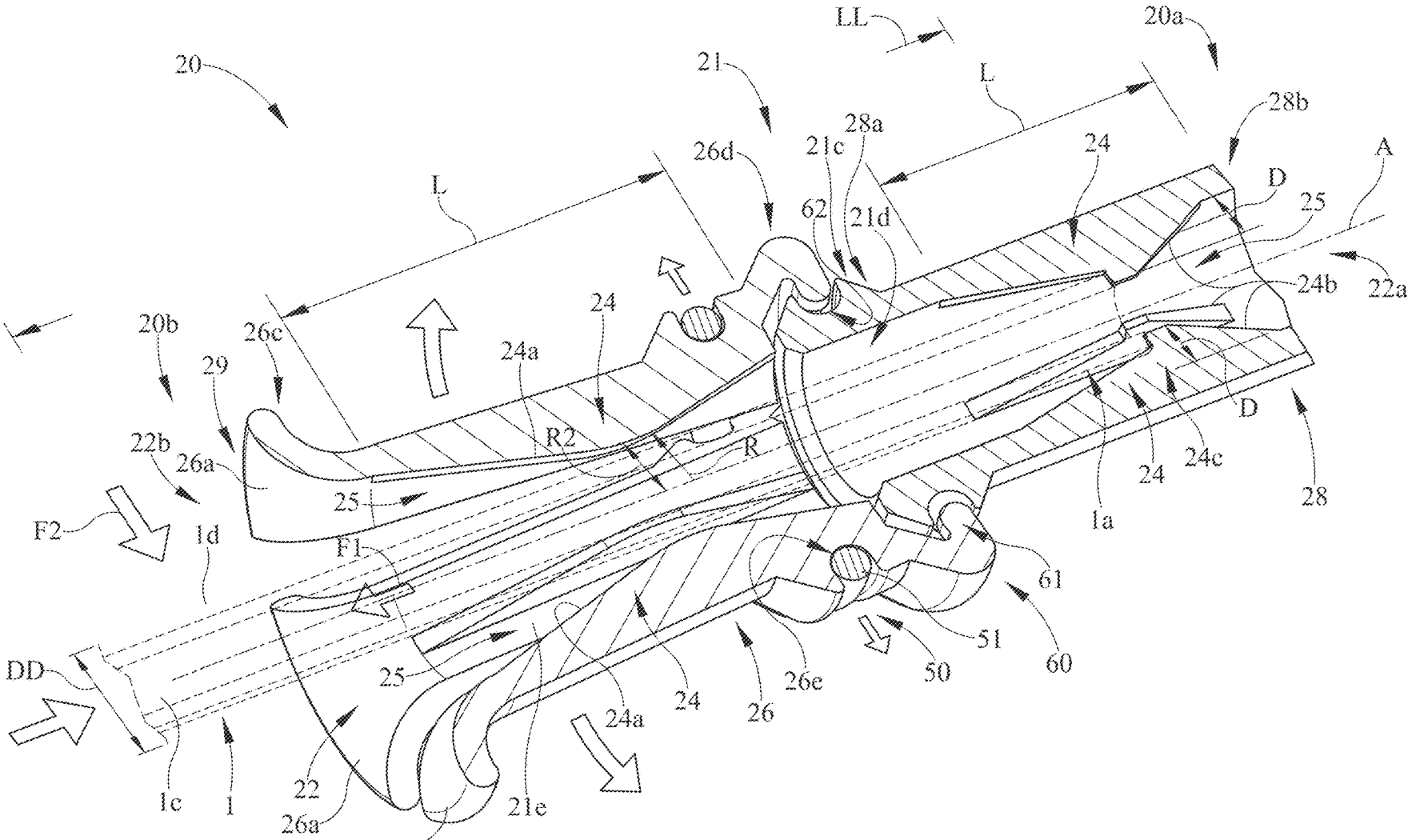
FIG. 2 is a sectional view of one embodiment of a carrier taken along line 2-2 being adjustable for one or more straws having a variety of lengths/diameters, and illustrating a straw being loaded into the carrier, expanding a biasing mechanism, and the pivoting members in a second position.
Figure 3:
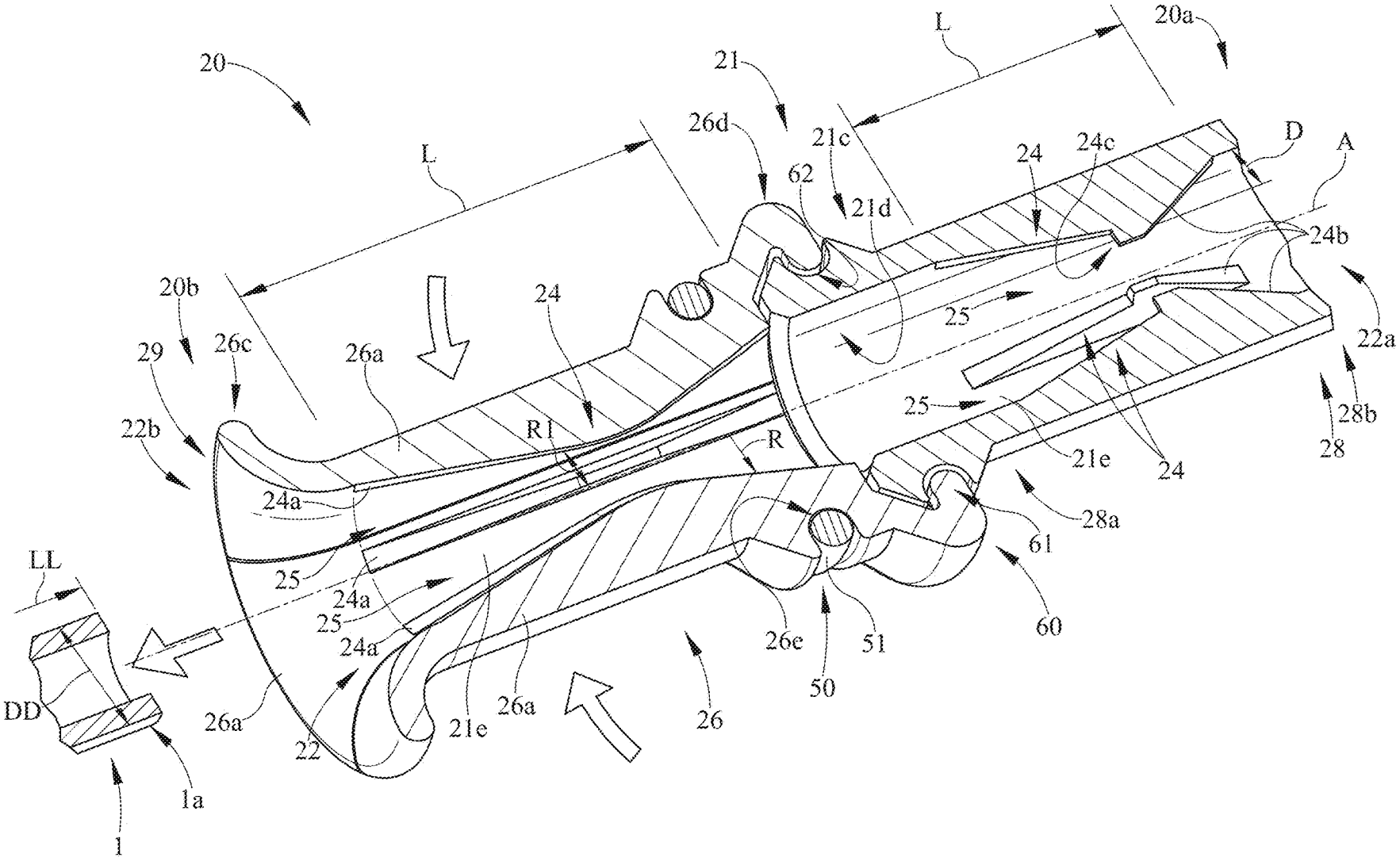
FIG. 3 is a sectional view of the carrier of FIG. 2 illustrating the straw unloaded from the carrier, the biasing mechanism compressing the pivoting members inwardly, and the pivoting members in a first position, wherein the first position is at a smaller radius than the second position.
Figure 4:
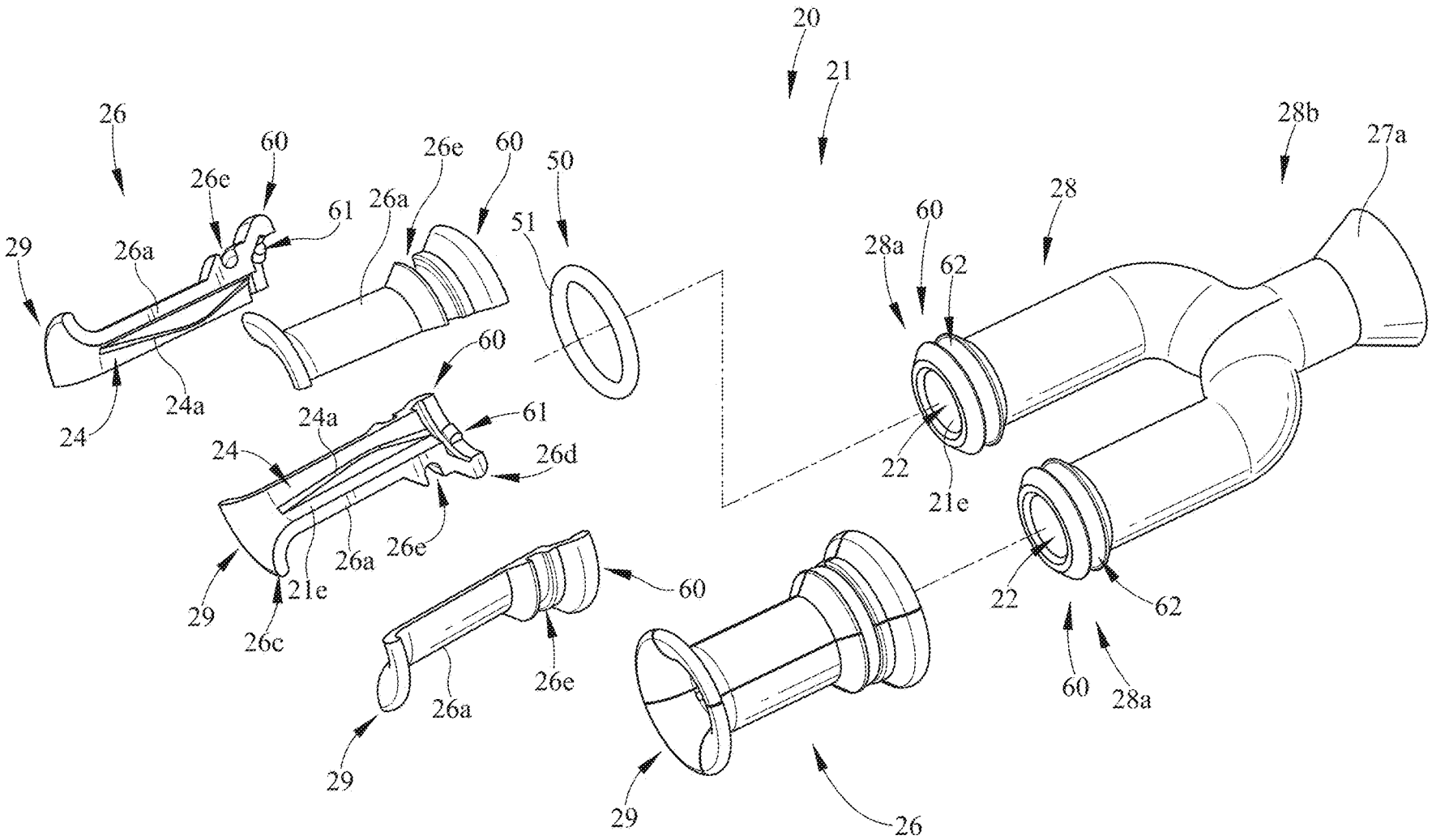
FIG. 4 is a perspective view of the carrier of FIG. 2.
Figures 5, 5A:
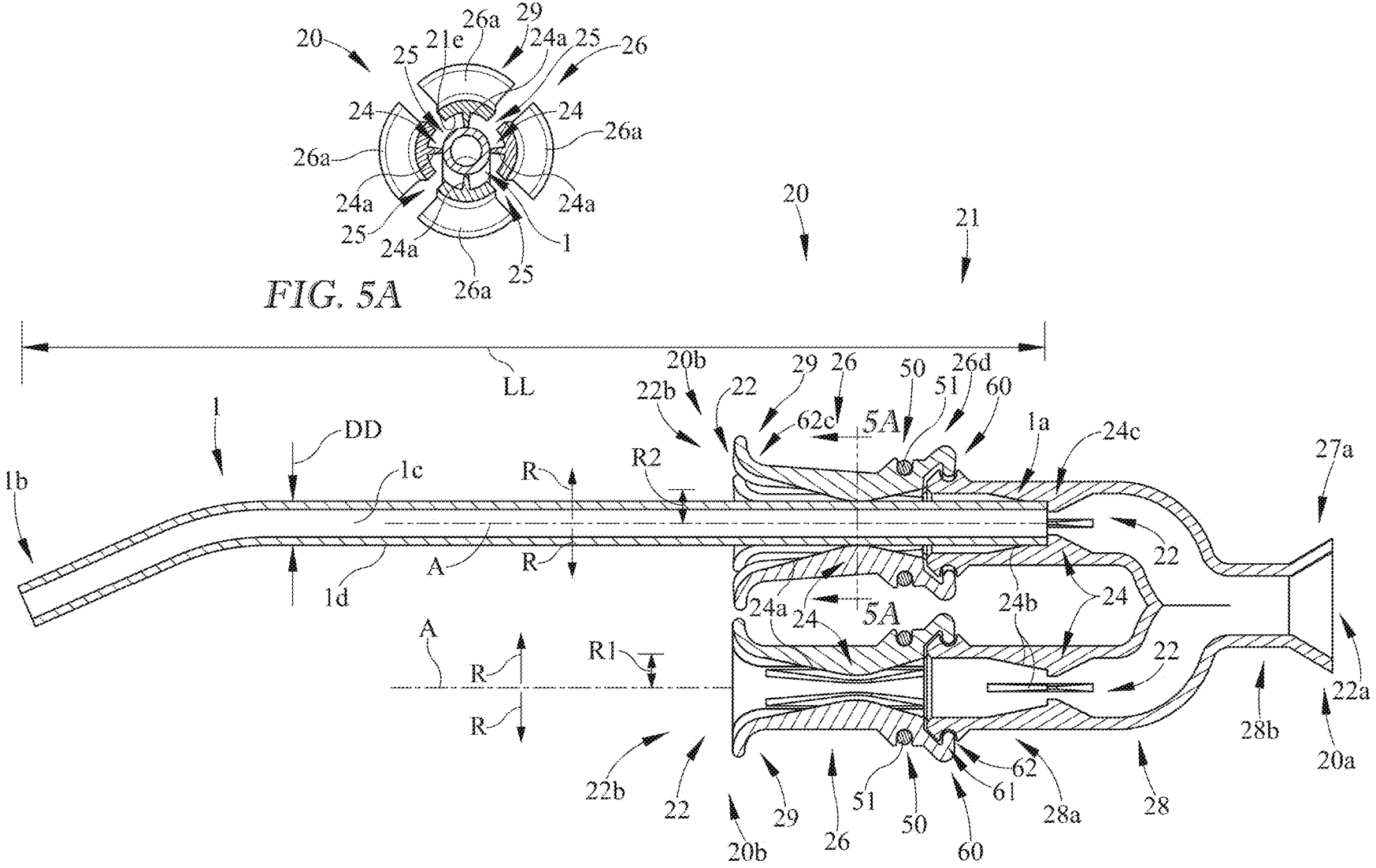
FIG. 5 is a sectional view of one embodiment of the carrier of FIG. 2 taken along line 5-5 illustrating a straw loaded into one receptacle of the carrier and another receptacle of the carrier without a straw loaded therein.
FIG. 5A is a sectional view taken along line 5*a*-5*a* of FIG. 5.
Figure 6:
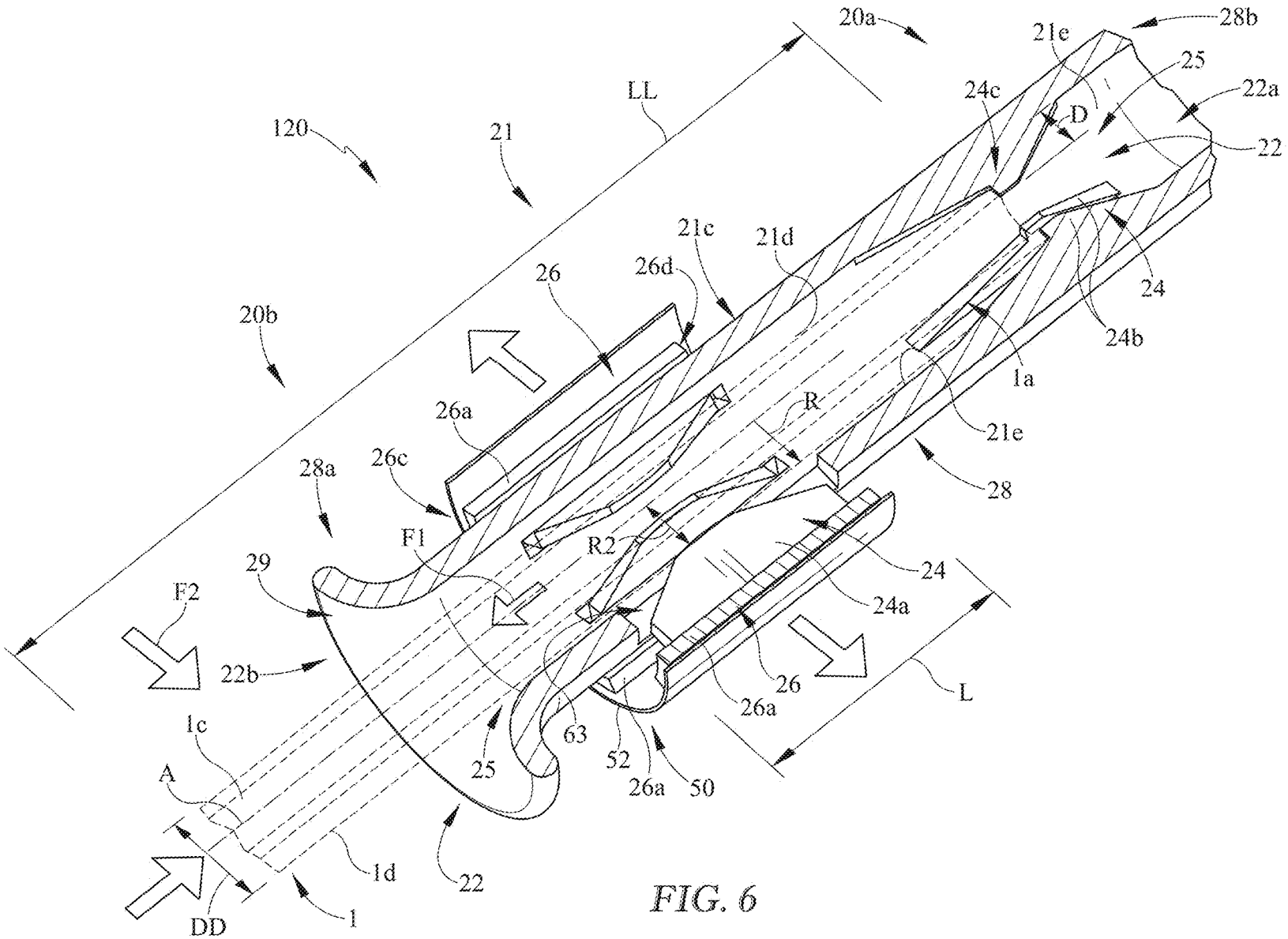
FIG. 6 is a sectional view of another embodiment of a carrier taken along line 6-6 being adjustable for one or more straws having a variety of lengths/diameters, and illustrating a straw being loaded into the carrier, expanding a biasing mechanism, and the sliding members in a second position.
Figure 7:
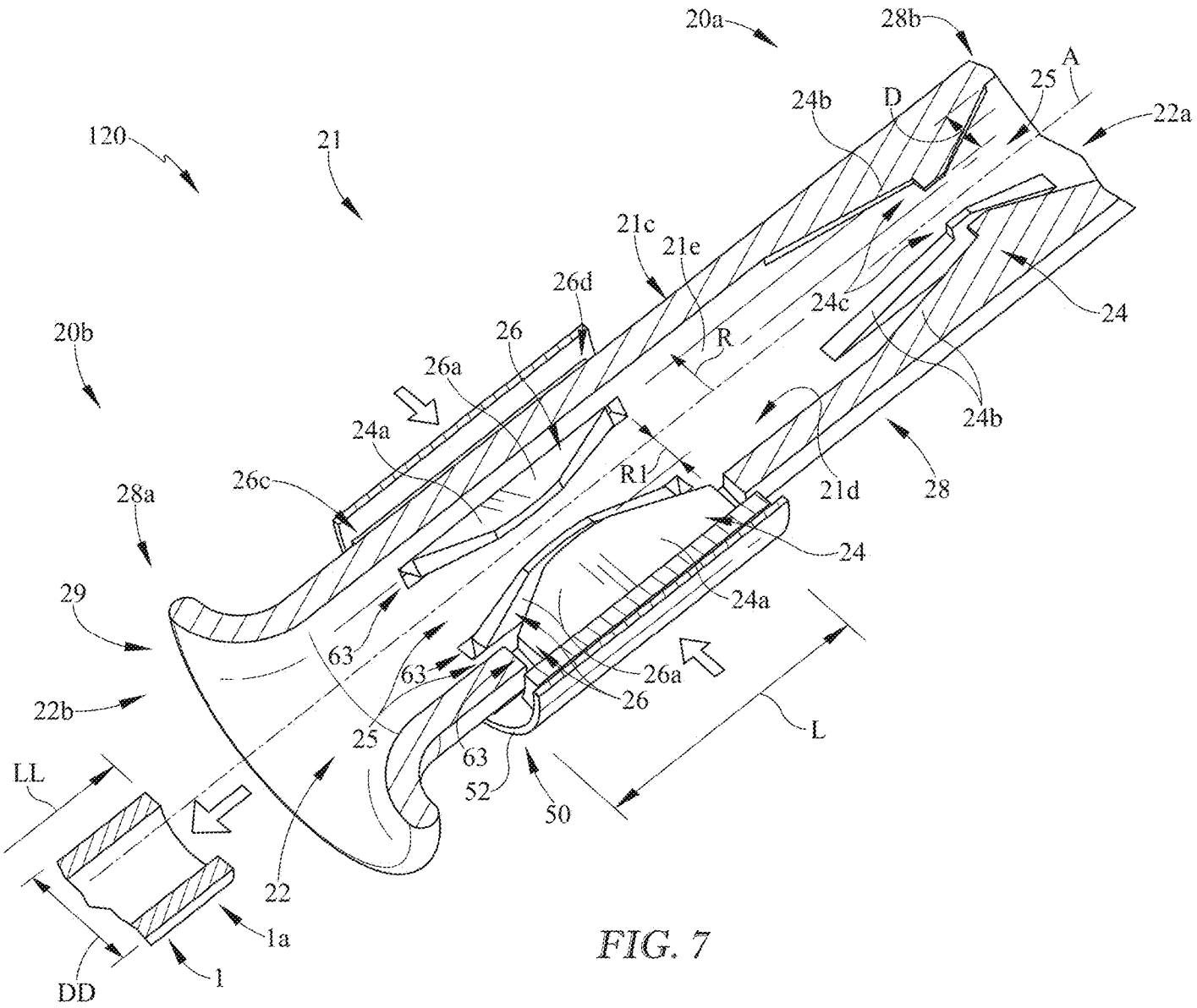
FIG. 7 is a sectional view of the carrier of FIG. 6 illustrating the straw unloaded from the carrier, the biasing mechanism compressing the sliding members inwardly, and the sliding members in a first position, wherein the first position is at a smaller radius than the second position.
Figure 8:
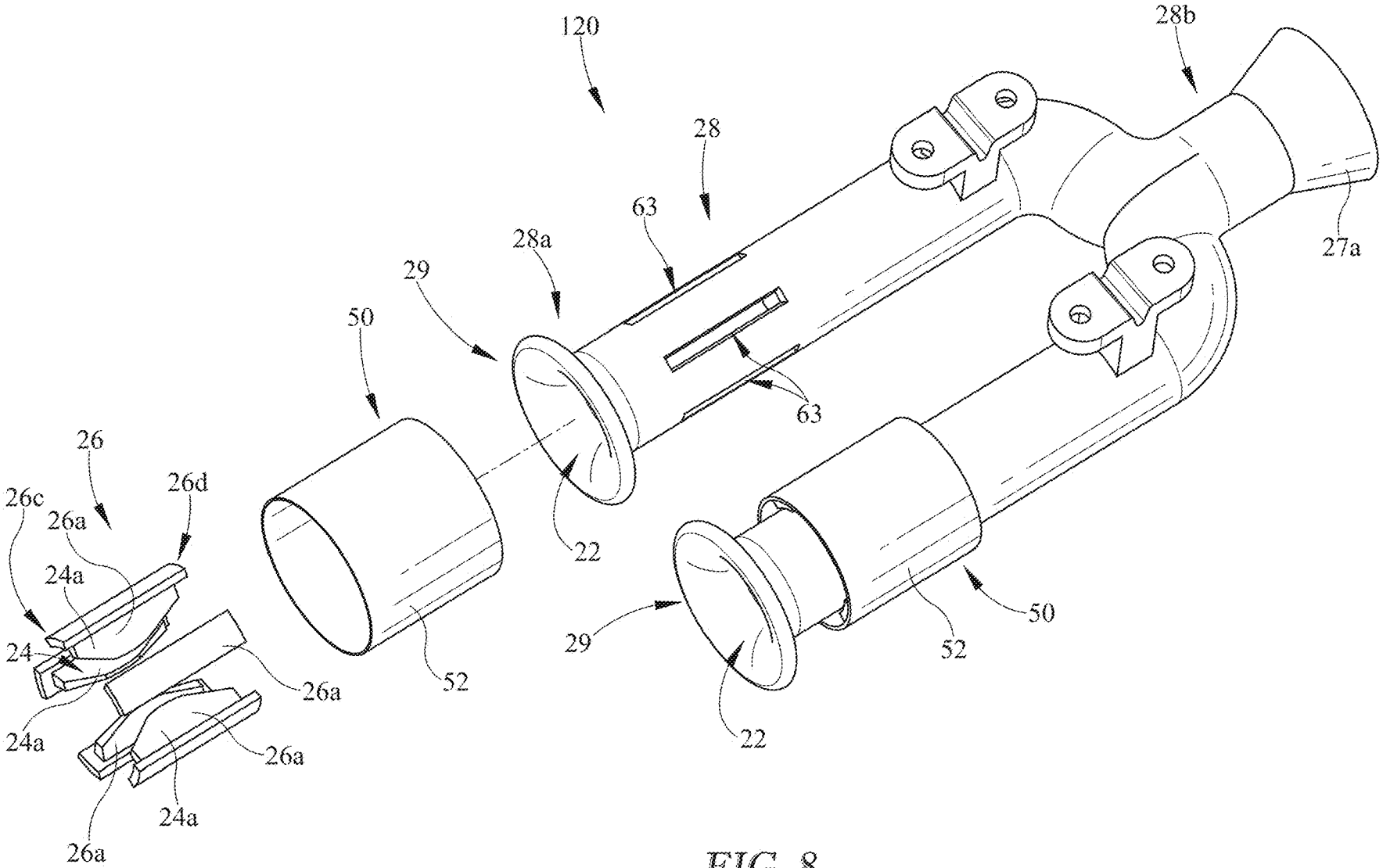
FIG. 8 is a perspective view of the carrier of FIG. 6.
Figures 9, 9A:
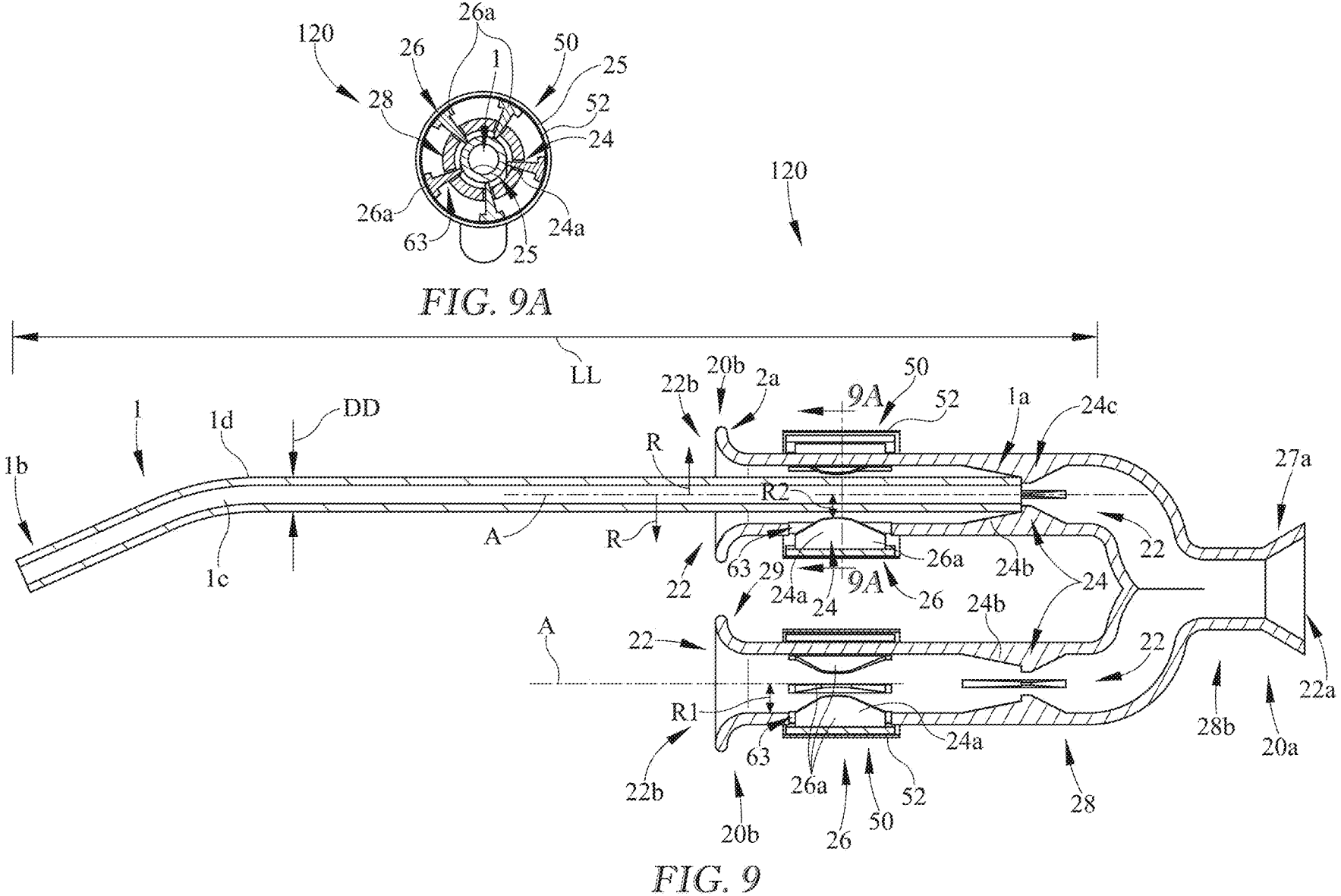
FIG. 9 is a sectional view of one embodiment of the carrier of FIG. 6 taken along line 9-9 illustrating a straw loaded into one receptacle of the carrier and another receptacle of the carrier without a straw loaded therein.
FIG. 9A is a sectional view taken along line 9*a*-9*a* of FIG. 9.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described apparatus and techniques within a front-load residential dish washing machine such as dish washing or dish washing appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments.

Embodiments for a dish washing machine 10 are shown herein for ease of understanding. For example, a front-load dish washing machine that includes a front-mounted door 12 in a cabinet or housing 11 that provides access to a horizontally-oriented dishwasher rack 30 housed within the cabinet or housing 11 may be used. More specifically, the dishwasher rack 30 may be housed in a dishwasher tub 14. Implementation of the herein-described apparatus and techniques within a variety of appliances would be well within the abilities of one of ordinary skill in the art having the benefit of the instant disclosure, so the invention is not limited to the front-load dish washing implementation discussed further herein. For example, the apparatus and techniques may be used with a dishwasher drawer of a dish washing appliance.

Turning now to the drawings, wherein like numbers denote like parts throughout the several views, FIG. 1 illustrates an example dish washing appliance 10 in which the various technologies and techniques described herein may be implemented. Dish washing appliance 10 is a front-load dish washing machine, and as such may include a front-mounted door 12 defining an opening 13 that provides access to a horizontally-oriented dishwasher tub 14. The tub 14 may be defined by at least a rear wall 15 interconnected by two opposing side walls, bottom wall, and a top wall. The door 12 may be coupled with a cabinet or housing 11 that may house the dishwasher tub 14 in some embodiments. Door 12 is generally hinged along a front or front edge of the housing 11 adjacent the opening 13 and is pivotable between the closed position illustrated in FIG. 1 and an open position (not shown). When door 12 is in the open position, dishes, utensils, pans, straws 1, one or more carriers 20, and/or 120, and other washable items may be inserted into and removed from the one or more dishwasher racks 30 through the opening 13 in the front of cabinet or housing 11. Control over dish washing appliance 10 by a user is generally managed through a control panel (not shown) disposed on a door 12 and implementing a user interface, and it will be appreciated that in different dish washing machine designs, control panel may include various types of input and/or output devices, including various knobs, buttons, lights, switches, textual and/or graphical displays, touch screens, etc. through which a user may configure one or more settings and start and stop the wash cycle or straw washing operation as described herein. For example, the control panel, or portions thereof, may be included with the dishwasher rack, on the interior or exterior of the door, and/or adjacent the rack within the opening of the dish washing machine. For example, in some embodiments, portions of the controls may be accessible when the door is in the open position.

As shown in the figures, the one or more dishwasher racks 30, or portions thereof, may be positionable relative to the dish washing appliance 10 between a stowed or un-deployed position (FIG. 1) and a deployed or different position (not shown). At least one of the stowed positions of the dishwasher rack 30 may be used when one or more of the washing or straw washing cycles is in operation. In use, the deployed position may be one or more horizontal positions different from one or more of the stowed positions. For example, one deployed position or partially opened position may be a position other than when the rack is in its fully extended position out of the dishwasher tub 14. One or more deployed positions may be a horizontal position to dry, load, and/or unload dishes, utensils, one or more straws 1, one or more carrier(s) 20 and/or 120, or the like. The one or more dishwasher racks 30 and/or carrier may travel in a substantially horizontal plane. The horizontal plane may be into and/or out of the dishwasher tub 14 or cavity. Although the substantially linear movement of the dishwasher rack cycle and/or carrier may occur along the horizontal plane in a variety of heights as shown, the linear travel may be in a variety of angles in one or both the directions into or out of a position. The straw carriers may be moveable between positions and/or fixed in position relative to the dish washing appliance, or portions thereof and still be in at least one position to be in fluid communication with and/or used to receive fluid (e.g. first fluid F1, second fluid F2, etc.) from one or more spray elements 40.

As illustrated in the figures, one or more collet straw carriers or carriers 20, 120 may be used to releasably engage, receive, or temporarily retain one or more straws 1 to be washed within the dishwasher 10 and/or rack 30. The straws 1 may be a variety of shapes, sizes, constructions, and quantities. For example, a variety of outer diameters DD and/or lengths. The one or more carriers 20, 120 may be supported within the rack 30 (e.g. upper or third rack) and deployed with the rack 30 from at least one stowed position (See FIG. 1) to at least one deployed position. Alternatively, the carrier may be positioned in the tub separate from the rack. In the deployed position, one or more straws 1 may be inserted or removed from the carrier 20, 120. In the stowed position, the carrier 20, 120 may be in fluid communication with and/or used to receive fluid (e.g. first fluid F1, second fluid F2, etc.) from one or more spray elements 40 (e.g. docking station 41, spray arm 42, etc.) to wash an interior and/or exterior of the one or more straws 1 positioned/received within the carrier 20, 120. The carrier may fluidly engage or be configured to receive fluid from the one or more spray elements 40 when in a position (e.g. stowed/deployed rack position). A spray collector 27*a*, if used, may receive fluid from the spray element 40. A pin jet sprayer, if used, may receive fluid from the spray element 40. Although the carrier 20, 120, or portions thereof, (e.g. first end 20*a*, inlet(s) 22*a*, spray collector 27*a*, pin jet sprayer) is shown in FIG. 1 as fluidly engaging and/or sealing against the spray element 40 (e.g. docking station 41) when in the stowed position (e.g. rack 30 and/or carrier), it should be understood that the carrier, or portions thereof, may be spaced (e.g. one or more distances) from the spray element and still be in fluid communication with the water supply/spray element during one or more wash or straw wash cycles.

In some implementations, the carrier 20, 120 and/or receptacle 22 may temporarily receive or releasably engage one or more straws 1 to receive fluid directed from the one or more spray elements 40 and route the received fluid across the one or more surfaces or peripheries of the respective straw 1. The carrier 20, 120 may include a body 21 having a first end 20*a* and an opposing second end 20*b*. The carrier 20, 120, fixed portion 28, and/or adjustable portion 26 may define one or more portions of the receptacle 22 extending between the first end 20*a* and the second end 20*b*. The first end 20*a* of the carrier 20, 120, may define one or more inlets 22*a* of the receptacle 22. The second end 20*b* of the carrier 20, 120 may define one or more outlets 22*b* of the receptacle 22. The second end 20*b* (e.g. fixed portion, adjustable portion) may define a funnel 29. The funnel 29 may define the receiving end or outlet 22*b* of the receptacle 22. The inlets 22*a* are in fluid communication with the outlets 22*b* along the length, or portion thereof, of the body 21. An end 1*a* or 1*b* of the straw 1 is positioned in the receptacle 22 between the inlet 22*a* and the outlet 22*b*, or downstream of the inlet 22*a* and upstream of the outlet 22*b*. The received fluid (e.g. first fluid F1) is directed from the inlet 22*a* past one end 1*a* of the straw 1 (e.g. first opening), progressively along the interior 1*c* and/or exterior 1*d* periphery of the straw 1, to discharge from the outlet 22*b* or receptacle 22. In some embodiments, the forced or received fluid is channeled through one or more pathways 25 along the body 21 or end 1*a*, 1*b*, or portions thereof, and the interior and/or exterior periphery 1*c*, 1*d* (e.g. portion of straw length) from the inlet 22*a* towards the outlet 22*b* of the receptacle 22 or body 21 to wash the straw 1, or portions thereof. A single straw 1 may be positioned in the receptacle 22 or carrier 20, 120. However, more than one straw may be received within the carrier or receptacles. The first end 20*a* or axial/terminating end of the carrier 20, 120 may define at least one inlet 22*a*. The inlet 22*a* may face axially away or upstream from the body 21 (e.g. elongated cylindrical shape) towards the spray element 40, rear wall 15, and/or in the direction of travel of the rack 30. The first end 20*a* of the body may include a spray collector 27*a*. In the one embodiment shown, the spray collector 27*a*, if used, may be a conical shape or funnel tapering towards the remaining portion of the carrier body 21 or second end 20*b* away from the first end 20*a*. In some implementations, the carrier 20, 120 and/or appliance 10/rack 30 may include one or more pin jet sprayers. The first end 20*a* may include the one or more pin jet sprayers. The pin jet sprayer, if used, may be used downstream of one or more docking stations 41 and/or spray collectors 27*a*, if used, to force received fluid (e.g. F1) through the carrier 20, 120 and/or straw interior/exterior 1*c*, 1*d*. The second end 20*b* or axial/receiving end of the carrier 20, 120 may define the outlet 22*b* and/or receptacle 22 releasably engaging/receiving the end 1*a* of the straw 1. The outlet 22*b* may face axially away or downstream from the body 21 (e.g. elongated cylindrical shape) towards the door 12, opening 13, and/or in the direction of travel of the rack 30. In the one embodiment shown in the Figures, the first end 20*a* may include a single inlet 22*a* and the downstream second end may include a plurality of outlets 22*b* and/or receptacles 22 downstream of one or more pathways connected to the inlet 22*a*.

In some implementations, the carrier 20, 120, or portions thereof, may be releasably or fixedly supported in one or more racks 30. The carrier 20, 120, or portions thereof, may be releasably attached to the rack. This may allow for different straw carriers 20, 120 to be used in one or more locations within the appliance 10 and/or racks 30. In other embodiments, the carrier 20, 120 may be fixed in position with the rack 30 or appliance. Further, although two carriers 20 and 120 are shown in the Figures within the rack 30, one or more carriers (e.g. same or different shapes, sizes, orientations, and/or positions) may be used in the rack 30 at the same/different times engaging one or more spray elements (e.g. same, different).

One or more carriers may be positioned in a variety of orientations within the rack 30 and still be in fluid communication with one or more spray elements 40. In the one embodiment shown in FIG. 1, the carrier 20, 120, straw 1, receptacle 22, inlets 22*a*, outlets 22*b*, and/or pathways 25 are orientated in a substantially horizontal position. The carrier 20, 120 may be positioned adjacent the rear of the rack 30. In some embodiments, the first end 20*a* and/or inlets 22*a* may be positioned adjacent the rear of the rack 30 or adjacent the rear wall 15 of the dishwasher tub 14 when in the stowed position. The second end 20*b* and/or outlets 22*b* may be positioned towards or adjacent the front of the rack 30 or adjacent the opening 13 of the dishwasher tub 14 when in the stowed position. When the carrier 20, 120 receives fluid from the spray element 40 in the one embodiment shown, at least some water or fluid (e.g. F1) is forced (e.g. horizontally) through the carrier 20, 120 from the inlet 22*a* towards the outlet 22*b* (e.g. from the rear wall 15 towards the opening 13 of the tub 14).

In some implementations, the appliance 10 and/or carrier 20, 120 may include one or more spray elements 40 or apertures. The spray element(s) 40 may be in fluid communication with one or more fluid supplies 16 to direct fluid from the fluid supply 16 into the dishwasher tub 14 and/or carrier(s) through the one or more spray elements 40 (e.g. one or more apertures, pathways, devices). One embodiment of the spray element 40 includes one or more docking stations 41 in fluid communication with the one or more carriers 20, 120. As shown in FIG. 1, the docking stations 41, if used, may be adjacent to or in the rear wall 15 of the dishwasher tub 14. The one or more inlets 22*a*/outlets 22*b* of the carrier 20, 120 are in downstream fluid communication with the one or more docking stations 41 or spray elements 40 when the rack/carrier is in the stowed position. Further, in some embodiments as shown in FIG. 1, the spray element 40 may include one or more spray arms 42. The spray arms 42, if used, may direct water or fluid into or towards the carrier 20, 120 to wash one or more portions of the straw(s) 1. As shown in the one embodiment in FIG. 1, the spray arm 42 (e.g. positioned above the carrier 20, 120) sprays or directs fluid (e.g. F2) from one or more apertures towards (e.g. downwardly) at least an exterior periphery 1*d* of the straw 1 and/or interior/exterior of the carrier (e.g. secondary openings and/or spacing/gaps between movable/fixed portions) and/or the docking station 41 sprays or directs fluid (e.g. F1) from one or more apertures towards the interior/exterior of the straw 1 and/or interior of the carrier. Although not shown, it should be understood that the spray arm, in some embodiments, may direct fluid towards the interior of the straw alone or in combination with the exterior of the straw.

In some implementations, the carrier 20, 120, adjustable portion 26 (e.g. member(s) 26*a*), fixed portion 28, and/or dish washing appliance 10 may include one or more bridges, stands, splines, or offsets 24 to create or define fluid pathways 25, or portions thereof, around the one or more straws 1 (e.g. interior and/or exterior). The adjustable portion 26 and/or fixed portion 28 (e.g. interior wall/periphery/members) may include one or more splines 24, if used. In the one embodiment shown in the FIGS. 2-9A and 11-13, the one or more splines 24 may include one or more protrusions 24*a* (e.g. elongated, extend for a length along axis of receptacle) projecting from the interior wall 21*e* of the carrier interior 21*d*, member 26*a* (e.g. sliding, pivoting), and/or adjustable portion 26, or portions thereof. In the one embodiment shown in the FIGS. 2-9A and 11-13, the one or more splines 24 may include one or more protrusions 24*b* (e.g. elongated, extend for a length along axis of receptacle) projecting from the interior wall 21*e* of the carrier interior 21*d* and/or fixed portion 28, or portions thereof. The one or more protrusions 24*a* and/or 24*b*, if used, may space/position the one or more exterior peripheries 1*d* of the straw(s) from the remaining portion of the interior 21*d* of the body 21 and/or carrier 20, 120. The remaining portion of the interior 21*d* (e.g. internal wall) may not include the one or more protrusions or splines. The one or more protrusions 24*a*, 24*b* may project inwardly from the interior 21*d* of the body 21 towards the one or more straws 1, or portions thereof. One or more pathways 25 for received fluid (e.g. F1, F2) may be defined between the remaining portion of the carrier, one or more protrusions 24*a*, 24*b*, and/or the interior/exterior periphery 1*c*, 1*d* of the one or more straws 1. The one or more protrusions 24*a*, 24*b* may taper inwardly towards the straw 1. In some implementations, the one or more protrusions 24*a*, 24*b* may be radial protrusions. The one or more protrusions 24*a*, 24*b* may project (e.g. radially) from at least the interior wall 21*e* (e.g. cylindrical surface) inwardly (e.g. radially) towards the one or more straws 1. The distal free end of the protrusion(s) 24*a*, 24*b* may contact the exterior periphery and/or end(s) of the straw. The one or more pathways 25 may be defined between one or more adjacent protrusions 24*a*, 24*b*, and/or portions of the carrier/straw. The one or more protrusions 24*a*, 24*b* (e.g. radial) may be elongated. As shown in FIGS. 2-9A and 11-13, the radial protrusions 24*a*, 24*b*, if used, may be elongated and extend for a length L along one or more lengths or portions of the body (e.g. interior wall) of the carrier 20, 120 to engage one or more lengths/portions of the straw exterior periphery. The elongated protrusion 24, 24*a*, 24*b* may extend beyond the length and/or one or more ends 1*a* of the straw, or may not extend past the extent or terminal end 1*a* of the straw. As shown in FIGS. 2-9A and 11-13, the carrier 20, 120 and/or spline 24 may include an axial stop or stop mechanism 24*c*. The spline 24 or protrusion 24*a*, 24*b* (e.g. 24*b* on the fixed portion) may include the axial stop 24*c* radially projecting to engage/position/space the first end 1*a* and/or second end 1*b* of the straw from the first end 20*a* and/or inlet 22*a*. The axial stop 24*c* may extend for a distance D in the radial direction or along a radius to engage across the first end 1*a* and/or second end 1*b*, or portions thereof (e.g. one or more cylindrical ends defining the straw opening). Although not shown, the spline/protrusion 24*a*, 24*b* may not include the axial stop in some embodiments. The protrusions 24*a*, 24*b*, and/or 24*c* are shown as being in an annular pattern or annular/circumferentially spaced about the straw diameter/axis A and/or interior. It should be understood that the spline 24 and/or protrusions 24*a*, 24*b* (e.g. radial) may be of a variety of shapes, sizes, quantities, orientations, positions, and constructions and still be within the scope of the invention. For example, the elongated protrusions/splines (e.g. radial) may be in a nonlinear, spiral, or curve pattern about the longitudinal axis of the carrier/channel/straw in some embodiments rather than straight/axial in length as shown. Moreover, in some embodiments, the one or more protrusions may be curved, bumps, or domes in shape projecting from the one or more walls of the interior. Further, a plurality of protrusions may be aligned/patterned to form or define an elongated protrusion or offset extending for one or more lengths/circumferences. The protrusions 24*a* and/or splines 24 of the adjustable portion 26 may be tapered towards the outlet 22*b* and be tapered towards the inlet 22*a* as shown in FIGS. 2-9A and 11-13. As shown in the one embodiment in FIGS. 2-9A and 11-13, the protrusion 24*b* and/or splines 24 of the fixed portion 28 may be tapered towards the outlet 22*b* and be tapered towards the inlet 22*a*

Although not shown, the pin jet sprayer(s), if used, of the carrier may force the first fluid F1 through the interior periphery 1*c* and/or end 1*a* of the straw and/or exterior periphery 1*d*. The pin jet sprayer may be one or more nozzles to provide one or more spray patterns and/or flow rates.

In some implementations, one or more straw carriers 20, 120, or portions thereof, may be adjustable to releasably engage/secure one or more straws 1 of a variety of diameters DD and/or lengths LL within the appliance, or portions thereof (e.g. rack, dishwasher tub). For example, a first straw of a first diameter may be loaded/unloaded into the straw carrier 20, 120 in one application/wash cycle and a second straw of a second diameter, smaller than the first diameter, may be loaded/unloaded into the straw carrier 20, 120 in another application/wash cycle. This allows a single carrier/receptacle to secure one or more straws of different/same diameters DD. The length LL may be different/same and still be engaged by the collet straw carrier/receptacle receiving different/same diameter straws. The straw carrier 20, 120 or one or more adjustable/movable portions 26 (e.g. sliding members, pivoting members, members) adjusts/reconfigures/positions (e.g. diameters, first radius, second radius, etc.) between at least one first position and at least one second position, different from the first position, to coincide with the corresponding variety of diameters DD of the one or more straws 1 to be washed/secured. The straw carrier 20, 120 may compress, squeeze, clamp, pin, or secure the straw 1 from the opposing ends 1*a* or 1*b* of the straw 1 in some embodiments. One or more spray elements 40 may be in fluid communication with the collet straw carrier 20, 120 and/or straw 1 (e.g. interior, exterior, ends, etc.). For example, when the carrier engages the ends 1*a* or 1*b* of the straw 1, this may leave a portion (e.g. exterior periphery 1*d*) between the opposing ends 1*a*, 1*b* of the straw 1 capable of being exposed to one or more fluid supplies (e.g. spray arm 42, apertures, spray elements 40). Although the collet/adjustable straw carrier 20, 120 is shown positioned in the dishwasher rack 30, the carrier 20, 120 may be in a variety of positions with the dishwasher tub 14 and/or appliance 10. Although the receptacle is shown for a single straw, the receptacle 22 may releasably engage a plurality of straws of a variety of lengths/diameters (e.g. straws in parallel) in some embodiments.

In some implementations, one or more collet straw carriers 20, 120, or portions thereof, with one or more straws 1 may be positioned downstream of one or more spray elements or apertures 40 and/or fluid supplies 16. The carrier(s) 20, 120 and/or straw(s) 1 may be positioned downstream of one or more spray elements 40 (e.g. the one or more apertures, fluid supply). For example, as shown in the one embodiment in FIG. 1, at least one spray arm 42, if used, may direct fluid F2 towards at least an exterior periphery 1*d* of the straw 1. In some embodiments, the spray arm 42 may direct fluid towards an interior periphery 1*c*, alone or along with the exterior periphery 1*d*. In the one embodiment shown in FIGS. 1 and 10, the carrier 20, 120 (e.g. fixed portion) may engage, be adjacent to, and/or downstream of a docking station 41, aperture(s)/spray element 40, and/or fluid supply 16. The collet straw carrier 20, 120 (e.g. fixed portion) may have a spray collector 27*a*, if used, and/or nozzle, if used, (e.g. pin jet sprayer) in fluid communication with the spray element 40 and/or fluid supply 16.

As shown in FIGS. 1-13, the carrier or collet straw carrier 20, 120, rack 30, and/or appliance 10 may include one or more members, components, or portions 26, 28. The one or more members/portions (e.g. 26, 28), or portions thereof, may define the one or more receptacles 22, or portions thereof, for receiving the straw 1 (e.g. at least one end 1*a* or 1*b*, portion of straw length LL). The one or more members of the collet straw carrier 20, 120 may include one or more adjustable members or portions 26 moveable/adjustable relative to one or more fixed members or portions 28 to vary a radial distance R and/or position (e.g. first radial position, second radial position, etc.) between one or more members. The adjustable portion 26 (e.g. member), or portions thereof, of the carrier 20, 120 may move (e.g. linearly, horizontally, vertically, radially, pivotably, slidingly, angularly, etc.) between one or more positions (e.g. first, second, third, fourth, radial) relative to the fixed portion 28 to vary the radial distance R (e.g. increase, decrease) and/or position between one or more portions of the carrier (e.g. adjustable portion, fixed portion). By varying the distance or radius R between the fixed portion 28 and the adjustable portion 26, one or more straws 1 (e.g. opposing ends 1*a* or 1*b*) may be releasably engaged (e.g. compressed/engaged, uncompressed/disengaged, radially engaged/disengaged) within the carrier 20, 120 and/or rack 30. As shown in FIGS. 1, 2, 5, 5A, 6, 9, 9A, and 10-13, the adjustable portion 26 and/or the fixed portion 28 (e.g. receptacle 22) releasably engage at least one end of the straw 1. For example, the one or more adjustable portions 26 and/or receptacle 22 of the carrier(s) 20, 120 may releasably engage the first end 1*a* of the one or more straws 1 in one or more radial positions. The one or more fixed portion 28 and/or receptacle 22 of the carrier(s) 20, 120 may releasably engage the first end 1*a* of the one or more straws. The carrier 20, 120 may maintain the straw horizontally or angled relative to the horizontal in some embodiments. Although the straw 1 may be positioned substantially in a horizontal position as shown, the straw 1 may be orientated at an angle (e.g. 0 to 2) relative to the horizontal plane to assist in draining fluid from the straw (e.g. exterior periphery and/or interior periphery). For example, the carrier, or portions thereof, and/or the straw end 1*a* received in the receptacle 22 may be at a higher elevation than the other end 1*b* of the straw.

In some implementations, the collet straw carrier 20, 120 and/or appliance 10 may include the dishwasher rack 30. One or more of the collet straw carriers 20, 120 may be positioned in the rack 30 and in fluid communication with one or more spray elements 40.

In some implementations, the collet straw carrier 20, 120, rack 30, and/or dish washing appliance 10 may include one or more biasing mechanisms 50. One or more biasing mechanisms 50 may urge at least a portion of the one or more adjustable portions 26 or one or more members 26*a* (e.g. splines 24) towards or relative to (e.g. radially, inward) the one or more fix portions 28 (e.g. receptacle, axis), receptacle 22, straw 1 (e.g. end, exterior periphery), and/or remaining portions of the carrier 20, 120, or portions thereof. The one or more bias mechanisms 50 may urge the adjustable portion 26, or portions thereof, radially inward relative to the fixed portion 28 towards the exterior periphery 1*d* of the straw in the receptacle 22. The variety of positions (e.g. radial) of the adjustable portion(s) may vary the size and shape of the receptacle 22 and/or carrier 20, 120, or portions thereof. The larger the diameter DD of the straw 1, the more or larger force (e.g. spring force) is applied by the one or more biasing mechanisms 50 or portion(s) (e.g. member 26*a*, spline 24, 24*a*) of the adjustable portion 26 to the straw when in the secured or loaded position with the carrier 20, 120. The smaller the diameter DD of the straw 1, the less force (e.g. spring force) may be applied by the one or more biasing mechanisms 50 or portion(s) (e.g. member 26*a*, spline 24, 24*a*) of the adjustable portion 26 to the straw when in the secured or loaded position with the carrier 20, 120. Although the one or more biasing mechanisms 50 may be an elastic material as shown in the Figures, it should be understood that the biasing mechanism may be a variety of shapes, sizes, quantities, and constructions and still be within the scope of the invention. For example, one or more compression springs may be used. In the one embodiment shown in FIGS. 1-5A and 10-13, the biasing mechanism 50 is an O-ring 51 (e.g. elastic material). In the one embodiment shown in FIGS. 6-9A, the biasing mechanism is an elastic sleeve 52. The one or more biasing mechanisms 50 may extend circumferentially (e.g. 360 degrees, less than 360 degrees, a plurality of spaced apart degrees) about the axis A of the receptacle 22 or straw 1, and/or the adjustable portion/member(s) 26, 26*a*. The bias mechanism may engage one or more adjustable portions 26 or members 26*a* as shown in the Figures. The biasing mechanism 50 may engage at least one of the adjustable portion and/or the fixed portion when in one or more positions. The biasing mechanism 50 may engage one or more portions (e.g. lengths, members) of the adjustable portion 26 and/or first portion 28. As shown in the FIGS. 1 and 6-9A, the biasing mechanism 50 (e.g. sleeve) extends substantially the length of the spline 24 (e.g. 24*a*) or adjustable portion 26 (e.g. member 26*a*) and/or a portion of the fixed portion 28. As shown in FIGS. 1-5A and 10-13, the O-ring 51 or biasing mechanism 50 engages one end of the adjustable portion 26 or member 26*a* adjacent the fixed portion 28 (e.g. hinge, away from the outlet 22*b*). It should be understood that the bias mechanism 50 may be of a variety of shapes, sizes, quantities, positions, and constructions and still be within the scope of the invention.

In some implementations, the collet straw carrier 20, 120 may include one or more adjustable portions 26, one or more fixed portions 28, and/or one or more biasing mechanisms 50. The adjustable member/portion 26 may be moveable or positionable between one or more positions relative to the fixed member/portion 28 to vary the radial position and/or radial distance R between the adjustable portion and the fixed/remaining portion. Varying the position (e.g. radial position(s)) of the adjustable portion 26 (e.g. one or more members 26*a*) relative to the fixed portion 28 may releasably engage the straw 1 (e.g. at least one end). Varying the position of the adjustable portion 26 may vary (e.g. size, shape) the receptacle 22 (e.g. interior wall(s) of the carrier). The biasing mechanism 50, if used, may position the adjustable portion 26 or members 26*a* relative to the fixed portion 28 to vary the radial distance R and/or adjust to the diameter DD of the straw 1. The straw 1, positioned (e.g. stowed within, deployed from) relative to the carrier 20, 120/receptacle 22, may position the adjustable portion 26 relative to the fixed portion 28 to vary the radial distance R and/or adjust to the diameter DD of the straw 1. The one or more adjustable portions 26 (e.g. members 26*a*), or portions thereof, may releasably engage at least one end 1*a* or 1*b* of the one or more straws 1. The adjustable portion 26 (e.g. member 26*a*) may be configurable between at least one first position at a first radius R1 (see FIGS. 3, 5, 7, 9, and 13) and at least one second position at a second radius R2 (see FIGS. 2, 5, 5A, 6, 9, 9A, and 13). In some embodiments, the second radius R2 may be larger than the first radius R1. Although not shown, in other embodiments, the first radius may be larger than the second radius. The biasing mechanism 50 may have a larger spring force when the adjustable portion 26, or portions thereof, is in the second position at the larger second radius R2 than the first position at the first radius R1. The biasing mechanism 50 may urge or move (e.g. pivotably, slidingly, linearly, arcuately) the adjustable portion 26 (e.g. member 26*a*) radially inward from the second position/radius R2 towards the first position/radius R1. Stowing the straw 1 or end 1*a* into the carrier/receptacle/adjustable portion/fixed portion, pushes or urges the adjustable portion 26 (e.g. member 26*a*) and/or bias mechanism 50 radially outward from the first position/radius R1 to the second position/radius R2. This may increase the spring force of the bias mechanism 50. When deployed the straw 1 or end 1*a* from the carrier/receptacle/adjustable portion/fixed portion, the outward force applied by the inserted straw 1 is reduced/removed allowing the adjustable portion 26 (e.g. member 26*a*) and/or bias mechanism 50 to move radially inward from the second position/radius R2 to the first position/radius R1. This may decrease the spring force of the bias mechanism 50. Moving the adjustable portion 26 (e.g. one or more members 26*a*) from the second position/radius R2 to the first position/radius R1 narrows the receptacle 22 and moving the adjustable portion 26 (e.g. one or more members 26*a*) from the first position/radius R1 to the second position/radius R2 to broadens the receptacle 22. It should be understood that different straws and/or straw diameters may correspond to different positions (e.g. radial) of the adjustable portion(s) 26 (e.g. members 26*s*) relative to the fixed portion(s).

In some implementations, the collet straw carrier 20, or portions thereof, may include one or more portions pivotably/hingedly connected to each other. The one or more adjustable portions 26 may be pivotably connected to the one or more fixed portions 28 to vary the relative positions (e.g. radial). In the one embodiment shown in FIGS. 1-5A and 10-13, one or more adjustable portions 26/members 26*a* is hingedly connected to the one or more fixed portions 28. The adjustable portion(s) 26 or member(s) 26*a* is hinged to the fixed portion(s) 28 between a variety of pivot angles to vary the radial distance R of the adjustable portion, or portions thereof. Although the pivoting member(s) 26*a* may pivot at angles relative to the axis A, other directions/movement/orientations are contemplated. The adjustable portion 26 may pivot between the first position/radius R1 (see FIGS. 3 and 13) and the second position/radius R2 (see FIGS. 2 and 13). The hinge 60 may be connected between a second end 26*d*, opposite a first end 26*c*, of the adjustable portion(s)/member(s) 26*a* and a first end 28*a*, opposite a second end 28*b*, of the fixed portion(s)/member(s) 28. The first end 26*c* of the adjustable portion(s) 26/member(s) 26*a* may define the funnel 29, receptacle 22, and/or outlet 22*b*, or portions thereof. The second end 26*d* of the adjustable portion(s) 26/member(s) 26*a* may define the hinge 60 and/or receptacle 22, or portions thereof. The hinge portion 60 of the adjustable portion 26 may be one or more tabs 61. Each hinged adjustable portion 26/member 26*a* may include at least one tab 61. The hinge portion 60 of the fixed portion 28 may be one or more first circumferential grooves 62. The first end 28*a* of the fixed portion(s) 28 may define the receptacle 22 and/or the first circumferential groove 62, or portions thereof. The second end 28*b* of the fixed portion(s) 28 may define the receptacle 22 and/or inlet 22*a*, or portions thereof. Although the hinge 60 is shown as a tab 61 pivotably engaging the first circumferential groove 62, a variety of hinges may be used and still be within the scope of the invention. The fixed portion 28 may be adjacent to or on the first end 20*a* and/or inlet 22*a* of the carrier 20 and the adjustable portion 26 may be adjacent to or on the second end 20*b* and/or outlet 22*b* of the carrier 20. The biasing mechanism 50 may engage one or more portions of the collet straw carrier 20. The biasing mechanism 50 (e.g. O-ring 51) may engage or be positioned only on the adjustable portion 26 as shown FIGS. 2-5A and 11-13. However, in some embodiments, the biasing mechanism 50 may engage the fixed portion or both the fixed portion and adjustable portion (see FIG. 7). The pivoting adjustable portion(s) 26 may include a second circumferential groove 26*e* receiving the biasing mechanism 50 (e.g. O-Ring), or portions thereof. Each member 26*a* may include a groove 26*e*, or portion thereof. The groove 26*e* may be substantially continuous in the first position/radius R1 and/or discontinuous in the second position/radius R2. A plurality of pivoting members 26*a* of the adjustable portion 26 may be pivotably connected to the hinged/fixed portion as shown, however it should be understood that at least two members 26*a* of the adjustable portion 26 may be used in some embodiments. In some embodiments, a single pivoting member may be used. The plurality of pivoting members 26*a* may splay open away from each other from the first position to the second position. The space between each adjustable member may be triangular in shape in at least the second position and/or increases (e.g. angle increases) as the radius R increases from the axis A of the receptacle 22. In the second position/radius R2, the adjacent first ends 26*c* of the adjustable portions 26/pivoting members 26*a* are spaced further from each other than the adjacent second ends 26*d* of the adjustable portions 26/pivoting members 26*a*. The first end 26*c*/spline 24/protrusion 24*a* of the pivoting member(s) 26*a* may be positionable between the first position/radius R1 and the second position/radius R2. The second end 26*d* of the pivoting members 26*a* may be at the first radius R1 in both the first and second pivoting positions. The adjustable portion 26 or pivoting members 26*a*, or portions thereof, may include one or more splines 24*a* projecting radially inward towards the axis A of the receptacle 22 or straw 1. The splines 24*a* and/or interior wall 21*e* may define the one or more pathways 25 about the straw 1. As shown in FIGS. 1-5A and 10-13, each pivoting member 26*a* of the adjustable portion 26 may include a spline 24*a*. The spline 24*a*, if used, may run for a length L in a direction from the outlet 22*b* towards the inlet 22*a*. The spline 24*a* may increase in height from the interior wall 21*e* of the adjustable portion then subsequently return or decrease in height to the interior wall 21*e* of the adjustable portion in a direction from the outlet 22*b* towards the inlet 22*a*. The fixed portion 28, or portions thereof, may include one or more splines 24*b* projecting radially inward towards the axis A of the receptacle 22 or straw 1. The splines 24*b* and/or interior wall 21*e* may define the one or more pathways 25 about the straw 1. The spline 24 (e.g. 24*b*), if used, may run for a length in a direction from the outlet 22*b* towards the inlet 22*a*. The spline/protrusion 24*b* may increase in height from the interior wall 21*e* of the adjustable portion then subsequently return or decrease in height to the interior wall 21*e* of the adjustable portion in a direction from the outlet 22*b* towards the inlet 22*a*. The spline/protrusion 24*b* and/or fixed portion 28 may include one or more axial stops 24*c*. The axial stop 24*c* of the spline(s) 24*b* may stop axial insertion or stowing of the end 1*a* of the straw 1. The adjustable portion 26 may be rotated about the axis A relative to the fixed portion 28.

In some implementations, the collet straw carrier 120, or portions thereof, may include one or more portions slidably connected to each other. The one or more adjustable portions 26 (e.g. members 26*a*) may be slidably connected to the one or more fixed portions 28 to vary the relative positions (e.g. radius). In the one embodiment shown in FIGS. 1 and 6-9A, one or more adjustable portions 26/members 26*a* (e.g. splines 24, protrusions 24*a*) is slidably connected to the one or more fixed portions 28. The adjustable portion(s) 26/members 26*a* is slidable relative to the fixed portion(s) 28 between a variety of radiuses/positions to vary the radial distance R of the adjustable portion 26/sliding members 26*a*, or portions thereof. The adjustable portion 26 (e.g. sliding members) may slide between the first position/radius R1 and the second position/radius R2. Although other directions are understood, the slidable member(s) 26*a* (e.g. spline) or adjustable portion 26 may slide perpendicular to the axis A of the receptacle 22 or straw 1 as shown. The adjustable portion 26 may include one or more slidable members 26*a*. The slidable members 26*a* may be or include splines 24/protrusions 24*a*. The slidable members 26*a* or adjustable portion 26 may include a variety of slidable engagements with the fixed portion 28. In the one embodiment shown in FIGS. 1 and 6-9A, the slidable engagement is a pin/member and slot engagement. The fixed portion 28 may include one or more slots 63. The slot(s) 63 may extend through the fixed portion 28 from the interior 21*d* to the exterior 21*c*. The slots 63 may be circumferentially spaced about the axis A. The slots 63 may be elongated for a length between the first end 28*a* and the second end 28*b* of the fixed portion 28. The one or more slots 63 of the fixed portion 28 may slidably receive one or more slidable members 62*a* or one or more splines 24 of the adjustable portion 26. The slidable members 26*a* (e.g. splines 24) may slide within the slots 63 between the first position/radius R1 (see FIG. 7) and the second radius R2 (see FIG. 6). The slidable members 26*a* (e.g. outer end) may engage the biasing mechanism 50 surrounding the fixed/adjustable portions 28, 26 when at a sliding position beyond the diameter or outer extent of the exterior 21*c* of the fixed portion. The slidable members 26*a* (e.g. inner end) may extend radially inward from the inner extent of the interior 21*d* of the fixed portion to define one or more pathways 25. The larger the diameter of straw 1 the more the slidable members 26*a* or splines 24 are pushed radially outward. The length of the slidable member 26*a* and/or slot 63 may be positioned between the first end 28*a* of the fixed portion 28 and the second end 28*b* of the fixed portion. The length of the slidable member 26*a* and/or slot 63 may be elongated and extend for a length along the axis A of the receptacle or for a portion of the length of the carrier. The fixed portion 28, or portions thereof, may include one or more splines/protrusions 24, 24*b* projecting radially inward towards the axis A of the receptacle 22 or straw 1. The splines 24*b* and/or interior wall 21*e* may define the one or more pathways 25 about the straw 1. The spline 24*b*, if used, may run for a length in a direction from the inlet 22*a* towards the outlet 22*b*. The spline 24*b* may increase in height from the interior wall 21*e* of the adjustable portion then subsequently return or decrease in height to the interior wall 21*e* of the adjustable portion in a direction from the outlet 22*b* towards the inlet 22*a*. The protrusion 24*b* and/or fixed portion 28 may include one or more axial stops 24*c*. The axial stop 24*c* of the spline(s)/protrusions 24, 24*b* may stop axial insertion or stowing of the end 1*a* of the straw 1. The biasing mechanism 50 may surround both the fixed and adjustable portion. Each one of the slidable members may engage the biasing mechanism (e.g. sleeve) for a length along the axis A. The sleeve 52 may extend past the longitudinal extents of the sliding member 26*a* in some embodiments. The funnel 29 may be defined by the fixed portion 28.

Although one embodiment of the axial stop or stop mechanism 24*c* is shown in the Figures, it should be understood that the axial stop may be a variety of shapes, sizes, quantities, positions, and constructions and still be within the scope of the invention.

Although the adjustable portion 26 and/or members 26*a* may pivot or slide relative to the fixed portion 28 to releasably engage the straw 1 (e.g. outer diameter/periphery), it should be understood that the adjustable/fixed portion may be of a variety of shapes, sizes, quantities, movement, engagements, and constructions and still be within the scope of the invention.

In use, the user may deploy the dishwasher rack 30 to load one or more straws 1 into the one or more collet straw carriers 20, 120. Alternatively, the one or more collet straw carriers 20, 120 may be inserted or coupled to the rack 30 if not already secured/fixed thereto. By increasing/decreasing or adjusting the radial distance R between the adjustable portion 26 (e.g. pivoting member(s), sliding member(s), spline 24) and the fixed portion 28 may allow one or more straws 1 to be loaded and/or unloaded from the collet straw carrier 20, 120. One end of the straw 1 may be inserted vertically (FIG. 10) and/or horizontally (FIG. 1) into one or more collet straw carriers 20, 120. Insertion (e.g. vertically, horizontally) of the straw end into the receptacle(s) 22 may vary the radial position (e.g. the defined diameter) of the one or more adjustable portions/members. As shown in the embodiment in FIGS. 1, 2, 5, 5A, 6, and 10-13, the user may engage one end 1*a* of the straw 1 to the second end 20*b*, outlet 22*b*, receptacle 22, fixed portion 28, and/or adjustable portion 26. The user and/or straw 1 may then be used to actuate or move (e.g. slide, pivot) the adjustable portion 26 or members 26*a* (e.g. sliding, pivoting) relative to the fixed portion 28 to position the adjustable portion 26 away (e.g. radially) from the fixed portion 28. Thereby the biasing mechanism 50, if used, may be stretched/biased when increasing the radial distance R of the one or more members 26*a* or adjustable portion 26. The biasing mechanism 50 urges the adjustable portion(s)/members 26, 26*a* against/towards the straw 1, thereby pinning the straw against another adjustable member/portion and/or fixed portion. Varying the radial distance R between the adjustable portion 26 and the fixed portion 28 releasably engages the end 1*a* of the one or more straws 1 of a variety of diameters DD. The diameter/radius R of the outlet 22*b* and/or receptacle 22 defined by the plurality of adjustable portions/members is larger in a second position (e.g. right side of FIG. 13, when the one end of the straw is received/loaded) than a first position (e.g. left side of FIG. 13, when the one end of the straw is removed/unloaded from the receptacle). Further, in some embodiments, the bias mechanism may include a larger spring force when the plurality of adjustable portions/members are in the second position than the first position. Once the one or more straws 1 (e.g. one end) are loaded (e.g. vertically, horizontally, both) in the collet straw carrier 20, 120, the rack 30 may be stowed within the dishwasher tub 14. In some embodiments as shown, the other end of straw may not be engaged by the straw collet carrier. When stowed, one or more portions of the carrier 20 may engage, fluidly couple, or be in fluid communication with one or more spray elements 40. For example, a spray element 40 (e.g. docking station) may spray fluid in the fixed portion, one or more ends of the straw, and/or through the nozzle (e.g. pin jet sprayer), if used, into or towards a straw. In some embodiments, a spray element 40 (e.g. one or more spray arms) may be used to direct fluid towards one or more portions of the straw 1 (e.g. exterior periphery). As shown in the Figures, the spray arm 42 and/or the docking station 41 may spray or direct fluid towards one or more portions of the straw. Once the one or more washing cycles are completed, the user may deploy the rack 30, if used, and unload the one or more straws 1. The manifold 80, if used, may drain at one or more times before, during, and/or after one or more wash cycles. The draining of the collet straw carrier and/or manifold may be through one or more drains 83, if used. The biasing mechanism 50, if used, may return itself, the adjustable portion 26, or portions thereof, to a rest or another position (e.g. smaller radial distance). Although a straw of a variety of diameters DD is shown engaged with the carrier 20, 120, it should be understood that the straw or other washable items may be a variety of shapes, sizes, quantities, and constructions may still be within the scope of the invention. For example, the straw may include an angle along its length. The carrier may engage one or more straws of a variety of lengths LL. Further, for example, the carrier may releasably engage washable items having exteriors other than circular. Further, washable items may not be hollow in some embodiments. For example, square, rectangular in cross section and/or solid cores. Other washable items may include, but is not limited to, appliance parts, baby items, etc.

It should be understood that the collet straw carrier may be a variety of shapes, sizes, quantities, orientations, and construction and still be within the scope of the invention. For example, the carrier/receptacle may releasably hold and wash two straws of different diameters in some embodiments.

Figure 10:
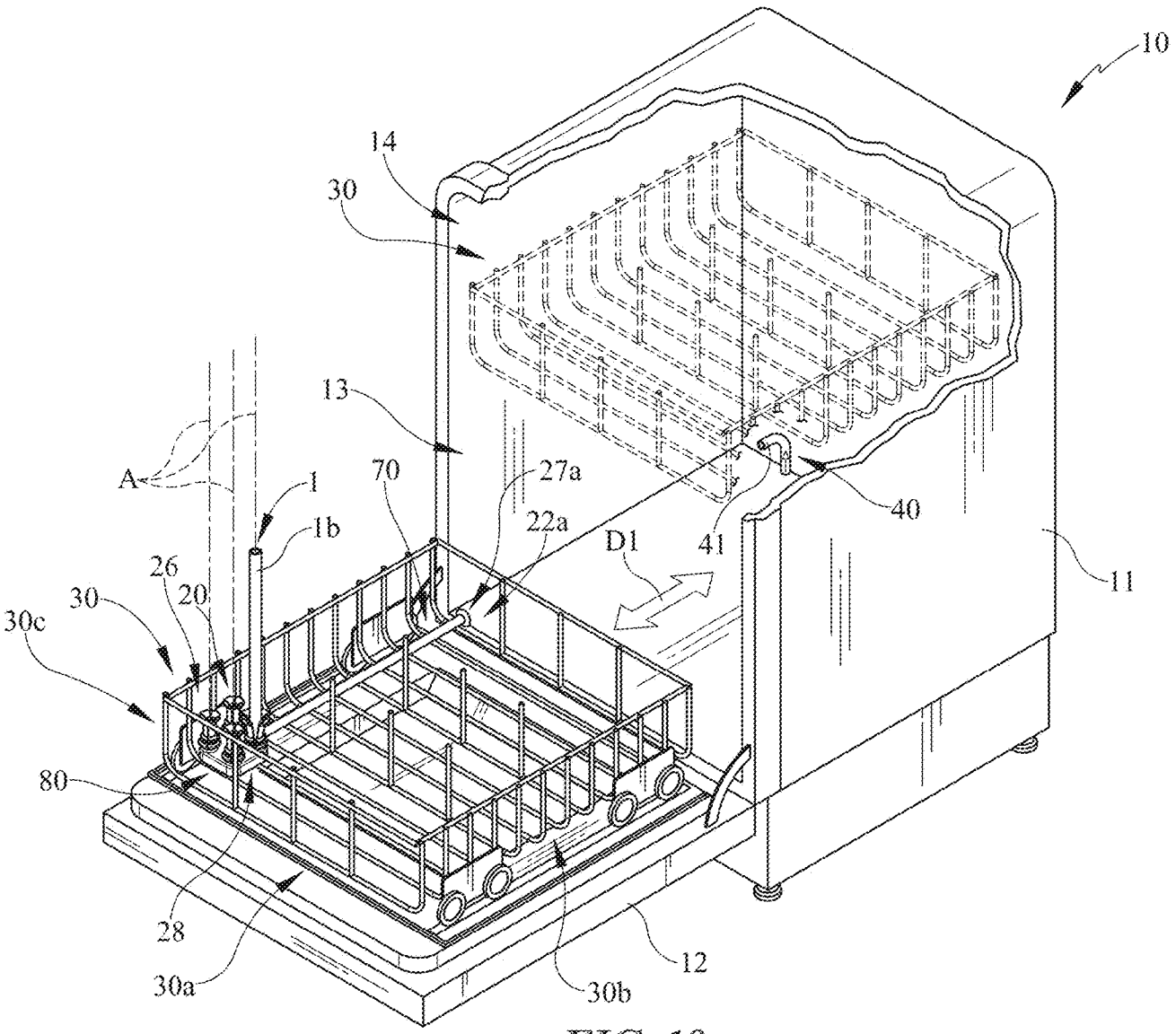
FIG. 10 is a perspective view of one embodiment of a lower/bottom retractable dishwasher rack illustrating an embodiment of a carrier for at least one straw supported by the deployed rack and configured to be in fluid communication with one or more spray elements, with portions of the housing and dishwasher tub removed.

In some implementations, one or more carriers 20, 120 and receptacles 22, or portions thereof, may be positioned in a substantially vertical orientation, or transverse orientation to the horizontal plane, within the rack 30 and/or still be in fluid communication with one or more spray elements 40 (e.g. when rack is stowed). For example, the receptacle and/or carrier 20, or portions thereof, may be perpendicular as shown in the one embodiment in FIG. 10 or angled relative to the horizontal plane. In the one embodiment shown in FIGS. 10-13, the carrier 20, straw 1, receptacle 22, inlets 22*a*, outlets 22*b*, and/or pathways 25 are orientated in a substantially vertical position. The carrier 20, 120 may be positioned in the bottom rack 30 as shown in FIG. 10. The carrier 20, or portions thereof, may be positioned adjacent the front opening 13 (e.g. when rack is stowed) and/or front side/edge 30*a* of the rack 30. The carrier 20, or portions thereof (e.g. manifold), may be positioned adjacent the bottom of the tub 14 and/or bottom side/edge 30*b* of the rack 30 and/or spaced away from the top side of the rack. In the one embodiment shown, the carrier, or portions thereof (e.g. manifold), is positioned in the corner 30*c* (e.g. front) of the dishwasher rack 30. In some embodiments, the conduit 70, first end 20*a*, and/or inlets 22*a* may be positioned adjacent the rear of the rack 30 or adjacent the rear wall 15 of the dishwasher tub 14 when in the stowed position. The second end 20*b* and/or outlets 22*b* may be positioned towards or adjacent the front side 30*a* of the rack 30 or adjacent the opening 13 of the dishwasher tub 14 when in the stowed position. When the carrier 20 receives fluid from the spray element 40 in the one embodiment shown, at least some water or fluid (e.g. F1) is forced (e.g. vertically) through the carrier 20 (e.g. conduit, manifold, receptacle, fixed portion, adjustable portion, with straw, without straw) and/or straw 1 from the inlet 22*a* towards the outlet 22*b* (e.g. exiting upwardly from the bottom side 30*b* of the rack).

In some implementations, the appliance 10, carrier 20, 120, and/or dishwasher rack 30 may include one or more conduits 70. The conduit(s) 70, if used, may be positioned downstream of the docking station(s) 41. The conduit(s) 70 may be positioned between the inlet 22*a*/first end 20*a*/spray collector 27*a* and the receptacle 22/fixed portion 28/adjustable portion 26, or portions thereof (e.g. manifold). The one or more conduits 70, if used, may be elongated and/or substantially linear. The conduit 70 may extend in a direction D1 of travel between the stowed position (FIG. 1) and deployed position (FIG. 10) of the dishwasher rack 30. The rack 30 may carry the conduit(s) 70, or portions thereof, between positions. The conduit may be in a substantially horizontal plane in some embodiments. The conduit 70 may be positioned adjacent the bottom side 30*b* of the dishwasher rack 30 and/or extend from the front side 30*a* to the opposing rear side of the rack 30. In the one embodiment shown, the conduit 70, manifold 80, and/or fixed/adjustable portions 28, 26 is positioned above and/or within the wire rack portions/periphery of the bottom side 30*b*. Alternatively, the conduit 70, manifold 80, and/or fixed/adjustable portions 28, 26 may be positioned below and/or outside the wire rack portions/periphery of the bottom side 30*b*. One end of the conduit 70, adjacent the rear side of the rack 30, may be adjacent to, be in fluid communication with, or include the inlet 22*a*, first end 20*a*, and/or spray collector 27*a*. The other end of the conduit 70 may be adjacent to, be in fluid communication with, or include the fixed portion 28 (e.g. first end 28*a*) and/or manifold 80.

In some implementations, the appliance 10, carrier 20, 120, fixed portion 28, and/or dishwasher rack 30 may include one or more manifolds 80. The manifold(s) 80, if used, may be positioned upstream of the receptacle 22 and/or downstream of the conduit 70/inlet 22*a*. In some embodiments, the fixed portion 28 may include one or more portions of the manifold 80. The manifold may include or define a chamber/volume 81. The bottom wall 82 of the manifold may include one or more drains 83. The drain(s) 83 may be used to remove remaining fluid from the chamber 81. The top wall 84, opposite to the bottom wall 82, may include the receptacle 22, fixed portion 28, and/or adjustable portion 26 projecting therefrom. The manifold may be positioned below (e.g. at a lower elevation) the receptacle 22, fixed portion 28, and/or adjustable portion 26. The manifold may be positioned adjacent the bottom side 30*b* of the dishwasher rack. The top wall 84 of the manifold 80 may include a nozzle(s) 85 or narrowing portion leading into the fixed portion 28, adjustable portion 26, and/or receptacle 22 (e.g. bottom), or portions thereof. The conduit 70 may be in fluid communication with, connected to, and/or positioned in a side wall(s) 86 of the manifold 80.

In some implementations as shown in FIGS. 10-13, the one or more axis A of the receptacle(s) 22, adjustable portion(s) 26, fixed portion(s) 28, outlet(s) 22*b*, bias mechanism(s) 50, and/or funnel(s) 29, or portions thereof, may be substantially perpendicular or transverse to the direction D1 of travel of the dishwasher rack 30. The one or more adjustable portions 26/members 26*a* may slide perpendicular to or in a perpendicular direction to the vertical axis A or in the horizontal plane in some embodiments. The one or more adjustable portions 26/members 26*a* may be hingedly connected to the fixed portion 28. The one or more adjustable portions 26/members 26*a* may pivot about an axis or hinge 60 perpendicular to the vertical axis A or in the horizontal plane in some embodiments. The one or more adjustable portions 26/members 26*a* may pivot one end (e.g. free/first end 26*c*) away from and/or towards the vertical axis A in some embodiments. The angle of the pivoting member 26*a* may increase and/or decrease relative to the vertical axis A. The one or more bias mechanisms 50 may extend about the vertical axis A or in the horizontal plane in some embodiments. The axis A may be perpendicular from the manifold 80, if used, bottom side 30*b* of the rack 30, and/or top wall 84. In various embodiments, the elongated protrusions 24*b* may project inwardly along the vertical axis A and taper towards the inlet 22*a* of the receptacle 22 and/or second end 28*b* of the fixed portion 28.

Figure 11:
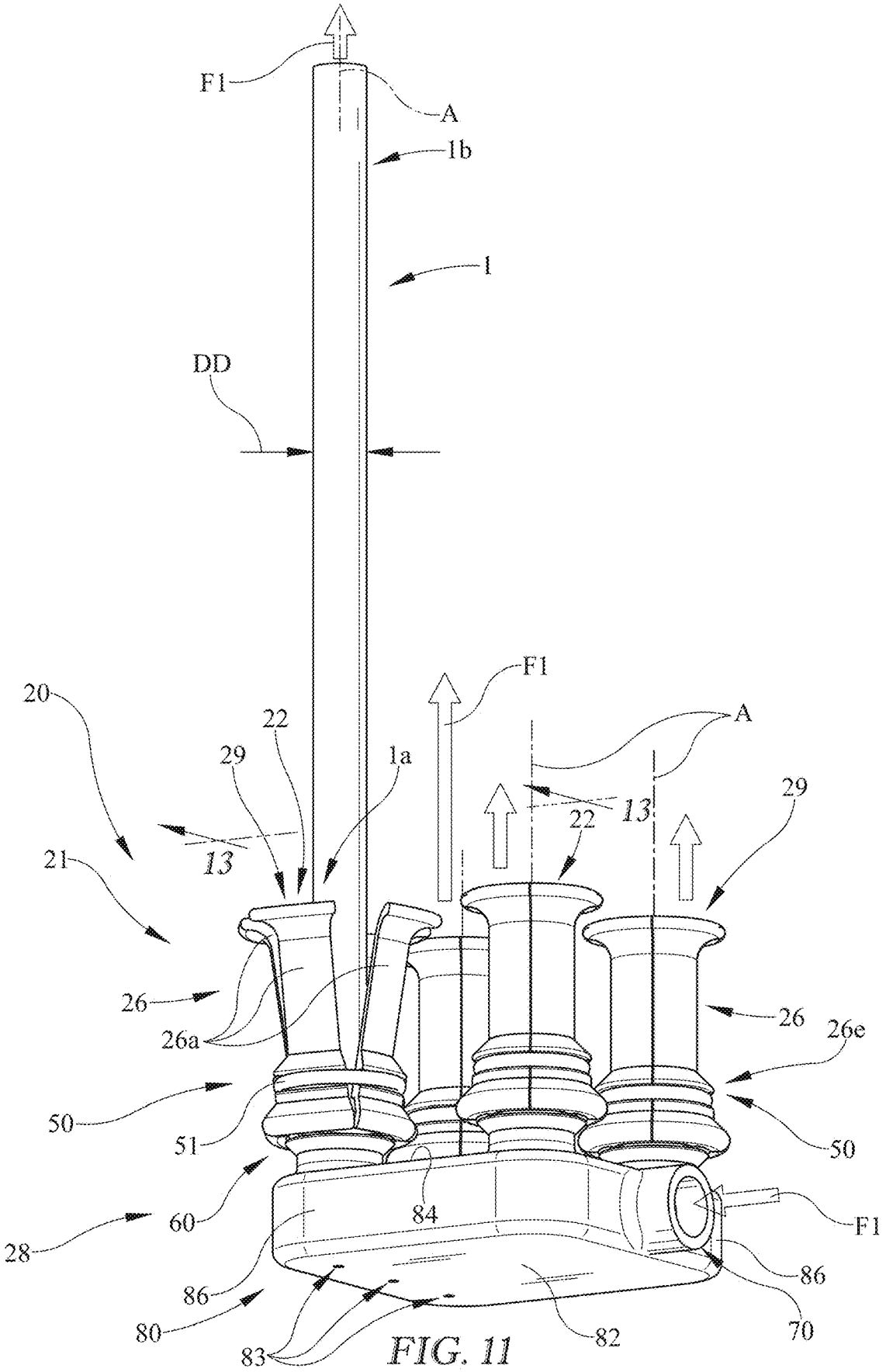
FIG. 11 is a bottom perspective view of the carrier of FIG. 10, and illustrating a straw loaded into one receptacle, expanding a biasing mechanism, and the pivoting members in a second position and another receptacle of the carrier without a straw loaded therein, the biasing mechanism compressing the pivoting members inwardly and/or at a rest position, and the pivoting members in a first position, wherein the first position is at a smaller radius than the second position.
Figure 12:
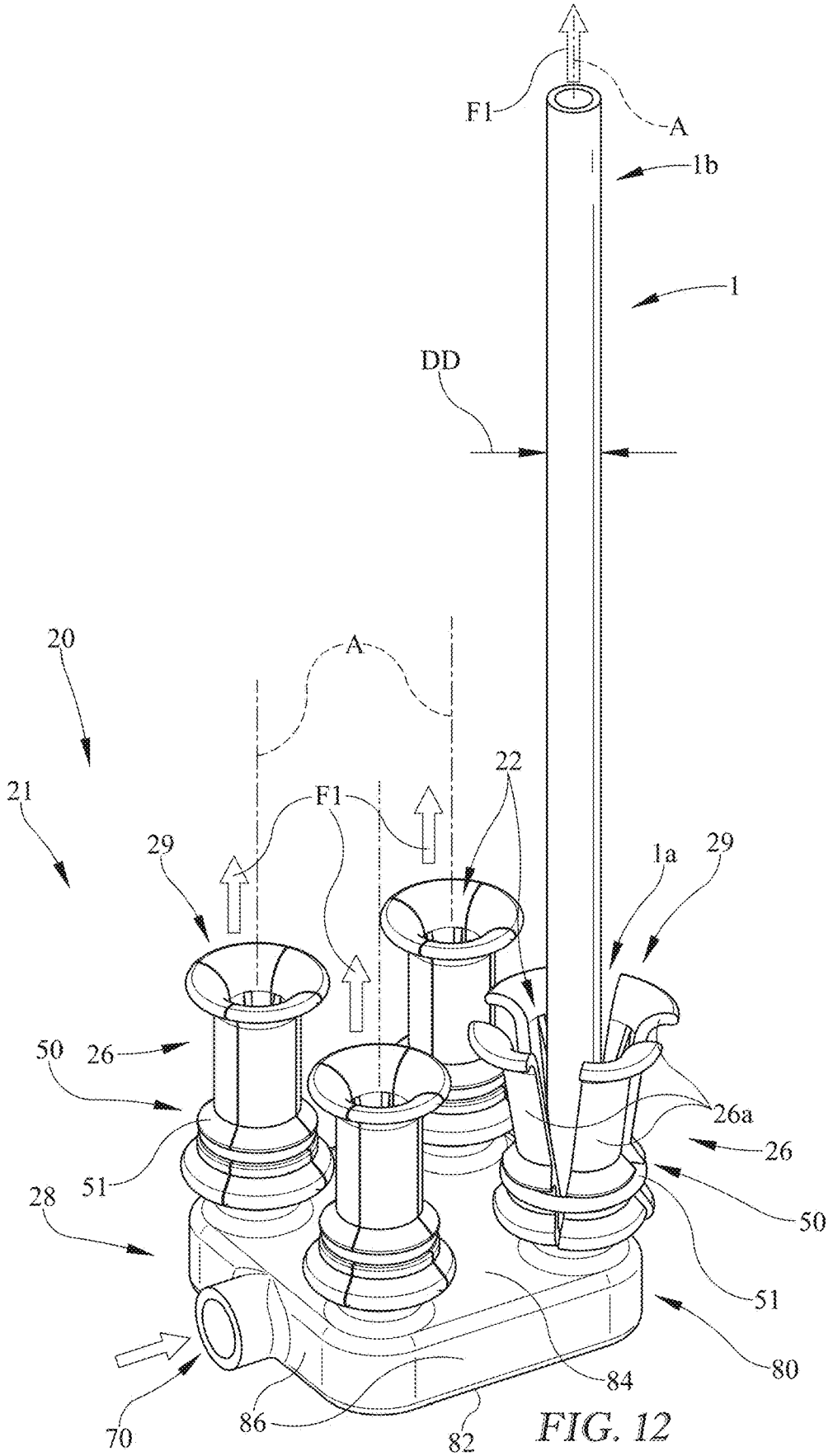
FIG. 12 is a top perspective view of the carrier of FIG. 10, and illustrating a straw loaded into one receptacle, expanding a biasing mechanism, and the pivoting members in a second position and another receptacle of the carrier without a straw loaded therein, the biasing mechanism compressing the pivoting members inwardly and/or at a rest position, and the pivoting members in a first position, wherein the first position is at a smaller radius than the second position.
Figure 13:
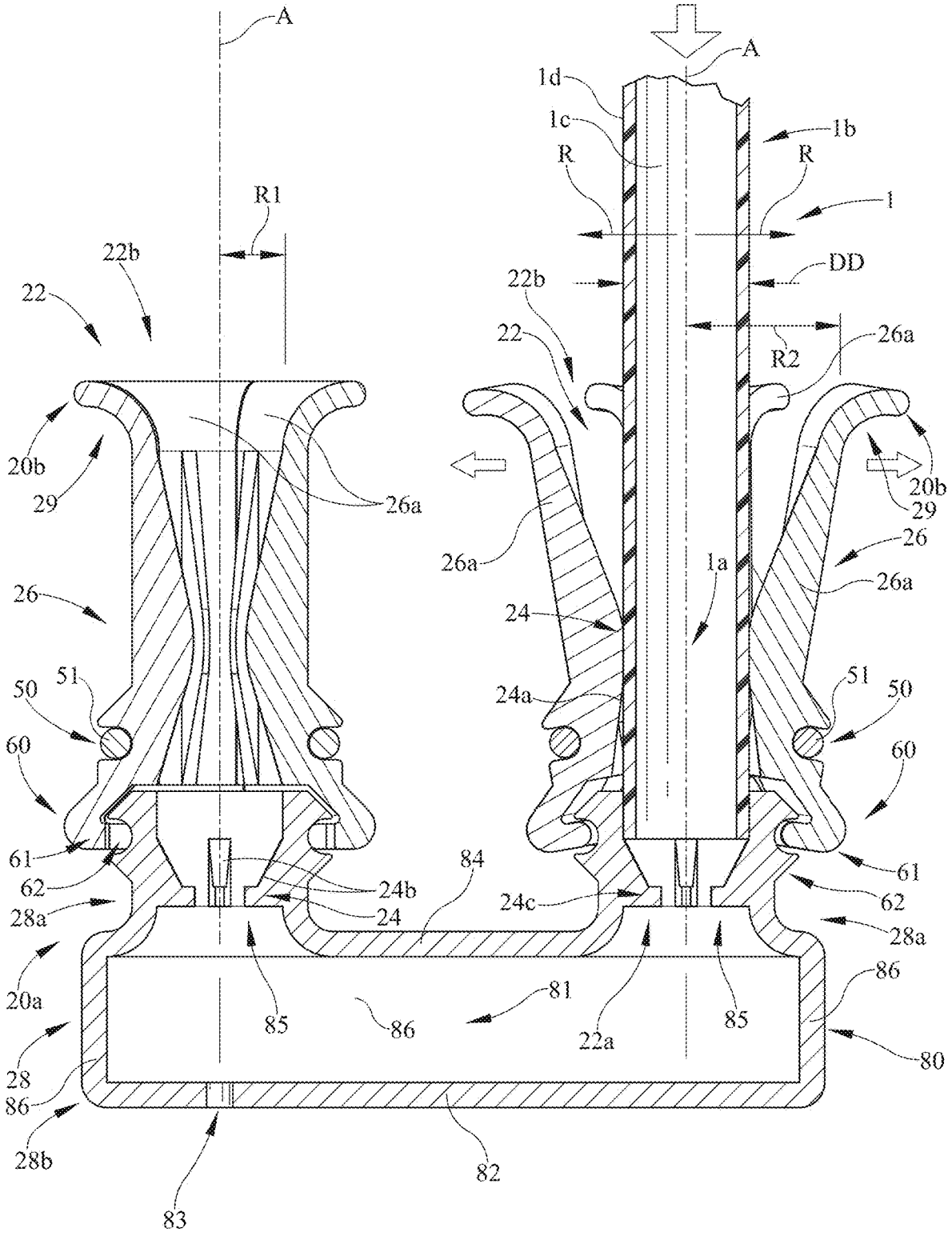
FIG. 13 is a sectional view taken along line 13-13 of FIG. 11.

In some implementations, the one or more collet straw carriers 20, 120, receptacle(s) 22, and/or fixed/adjustable portions may project upwardly away from the bottom side 30*b* of the dishwasher rack 30 and/or manifold 50. As shown in FIG. 11, the collet straw carrier 20 (e.g. adjustable portion, fixed portion) may project upwardly from the top wall 84 of the manifold 50 (e.g. along a vertical axis A).

In some implementations, the one or more collet straw carriers 20, 120 may include an upper/second end 20*b* and an opposing lower/first end 20*a*. The adjustable portion(s) 26 may be positioned above the fixed portion(s) 28. As shown in the one embodiment in FIG. 13, the one or more adjustable portions 26 are on or adjacent the upper end 20*b* and the one or more fixed portions 28 are on or adjacent the lower end 20*a*.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dishwasher rack for a dish washing appliance comprising:

one or more collet straw carriers having one or more fixed portions and one or more adjustable portions defining one or more receptacles configured to each receive an end of a straw, and wherein an axis of the one or more receptacles are perpendicular to a direction of travel of the dishwasher rack;

one or more biasing mechanisms, wherein the one or more biasing mechanisms urges the one or more adjustable portions relative to the one or more fixed portions to releasably engage an end of a straw within the one or more receptacles; and wherein the one or more adjustable portions include two of more pivoting members hingedly connected to the one or more fixed portions.

2. The dishwasher rack of claim 1 wherein the one or more biasing mechanisms urge the one or more adjustable portions radially inward relative to the fixed portion towards an end of a straw in the one or more receptacles.

3. The dishwasher rack of claim 1 further includes a front side, and wherein the one or more collet straw carriers is positioned adjacent the front side.

4. The dishwasher rack of claim 1 wherein the one or more adjustable portions are configurable between a first position at a first radius and a second position at a second radius larger than the first radius.

5. The dishwasher rack of claim 1 wherein the one or more collet straw carriers include an upper end and an opposing lower end, and the one or more adjustable portions are on the upper end and the one or more fixed portions are on the lower end.

6. The dishwasher rack of claim 1 wherein the one or more adjustable portions slide perpendicular to the axis of the one or more receptacles.

7. The dishwasher rack of claim 1 wherein the one or more bias mechanisms extend circumferentially about the axis of the receptacle.

8. The dishwasher rack of claim 1 further includes a bottom side, and wherein the fixed portion includes a manifold adjacent the bottom side, and wherein the manifold includes one or more drains.

9. A dish washing appliance comprising:

a dishwasher rack;

one or more spray elements disposed with the dishwasher rack, wherein the one or more spray elements is in fluid communication with a fluid supply to direct fluid from the fluid supply into the dishwasher rack;

one or more collet straw carriers positioned within the dishwasher rack and downstream of the one or more spray elements, wherein the carrier includes a fixed portion, an adjustable portion, and one or more biasing mechanisms, wherein the fixed portion and the adjustable portion define a receptacle configured to receive an end of a straw, and wherein the one or more biasing mechanisms urges the adjustable portion relative to the fixed portion to releasably engage an end of a straw within the receptacle;

wherein the adjustable portion includes a plurality of members, wherein the plurality of members define an outlet of the receptacle configured to receive one end of a straw;

wherein the outlet includes a diameter; and wherein the plurality of members are positionable between a first position and a second position, wherein the diameter of the outlet is larger in the second position than in first second position, and the bias mechanism includes a larger spring force when the plurality of members are in the second position than the first position.

10. The dish washing appliance of claim 9 wherein an axis of the receptacle is perpendicular to a direction of travel of the dishwasher rack.

11. The dish washing appliance of claim 10 wherein the adjustable portion is slidably connected to the fixed portion and slides in a perpendicular direction to the axis of the receptacle.

12. The dish washing appliance of claim 10 wherein the adjustable portion is hingedly connected to the fixed portion and pivots one end of the adjustable portion away from the axis of the receptacle.

13. The dish washing appliance of claim 9 wherein the one or more bias mechanisms extend circumferentially about the axis of the receptacle.

14. The dish washing appliance of claim 9 wherein the one or more biasing mechanisms urges the adjustable portion radially inward relative to the fixed portion towards an end of a straw in the receptacle.

15. The dish washing appliance of claim 9 further comprising a plurality of elongated protrusions projecting inwardly along the axis of the receptacle and tapering towards an inlet of the receptacle.

16. The dish washing appliance of claim 9 wherein the dishwasher rack is a bottom rack.

17. The dish washing appliance of claim 9 wherein the fixed portion includes a manifold, and wherein the manifold includes one or more drains.

18. A dishwasher rack for a dish washing appliance comprising:

one or more collet straw carriers having one or more fixed portions and one or more adjustable portions defining one or more receptacles configured to each receive an end of a straw, and wherein an axis of the one or more receptacles are perpendicular to a direction of travel of the dishwasher rack;

one or more biasing mechanisms, wherein the one or more biasing mechanisms urges the one or more adjustable portions relative to the one or more fixed portions to releasably engage an end of a straw within the one or more receptacles; and a bottom side, and wherein the fixed portion includes a manifold adjacent the bottom side, and wherein the manifold includes one or more drains.

19. The dishwasher rack of claim 18 wherein the one or more biasing mechanisms urge the one or more adjustable portions radially inward relative to the fixed portion towards an end of a straw in the one or more receptacles.

20. The dishwasher rack of claim 18 further includes a front side, and wherein the one or more collet straw carriers is positioned adjacent the front side.

21. The dishwasher rack of claim 18 wherein the one or more adjustable portions are configurable between a first position at a first radius and a second position at a second radius larger than the first radius.

22. The dishwasher rack of claim 18 wherein the one or more collet straw carriers include an upper end and an opposing lower end, and the one or more adjustable portions are on the upper end and the one or more fixed portions are on the lower end.

23. The dishwasher rack of claim 18 wherein the one or more adjustable portions slide perpendicular to the axis of the one or more receptacles.

24. The dishwasher rack of claim 18 wherein the one or more bias mechanisms extend circumferentially about the axis of the receptacle.

* * * * *